US005981162A

United States Patent [19]

Hioki et al.

[11] Patent Number: 5,981,162

[45] Date of Patent: Nov. 9, 1999

[54] SILVER HALIDE PHOTOGRAPHIC MATERIAL

[75] Inventors: Takanori Hioki; Katsuhisa Ohzeki; Takashi Katoh, all of Kanagawa, Japan

[73] Assignee: Fuji Photo Film Co., Ltd., Kanagawa, Japan

[21] Appl. No.: 09/073,763

[22] Filed: May 7, 1998

[30] Foreign Application Priority Data

May 8, 1997 [JP] Japan ..... 9-117950
Jul. 18, 1997 [JP] Japan ..... 9-193665

[51] Int. Cl.[6] ..... G03C 1/08; G03C 1/10

[52] U.S. Cl. ..... 430/595; 430/580; 430/592

[58] Field of Search ..... 430/570, 573, 430/578, 580, 581, 587, 590, 591, 592, 595

[56] References Cited

U.S. PATENT DOCUMENTS 2,166,736 7/1939 White et al. ..... 430/570
3,788,859 1/1974 Nakazawa et al. ..... 430/570
4,800,154 1/1989 Okazaki et al. ..... 430/570
5,756,277 5/1998 Sano ..... 430/569

*Primary Examiner*—Janet Baxter
*Assistant Examiner*—Amanda C. Walke
*Attorney, Agent, or Firm*—Sughrue, Mion, Zinn, Macpeak & Seas, PLLC

[57] ABSTRACT

A highly sensitive silver halide photographic material is described, which comprises at least one light-sensitive silver halide emulsion layer comprising at least one hemicyanine, hemioxonol, bishemicyanine or bishemioxonol dye having a particular structure and silver halide grains having an aspect ratio of from 3 to 50 or which comprises at least one light-sensitive silver halide emulsion layer comprising at least one bishemicyanine dye having a particular structure and silver halide grains at least 50%, based on projected area, of which are grains having a silver chloride content of at least 50 mole % and an outer surface at least 50% of which is constituted of (111) faces.

8 Claims, No Drawings

SILVER HALIDE PHOTOGRAPHIC MATERIAL

FIELD OF THE INVENTION

The present invention relates to a silver halide photographic material. Further, the invention is concerned with improvements in the art of spectrally sensitizing tetradecahedral, octahedral or tabular silver halide grains having (111) faces, wherein the halogen composition of the silver halide is chlorobromide, chloroiodide or chloroiodobromide each containing a high proportion of chloride.

BACKGROUND OF THE INVENTION

Hitherto, considerable efforts have been exerted to heightening the sensitivities of silver halide photographic materials. The sensitivity of a silver halide photographic material depends on both the latent image forming efficiency, including the light absorption and spectral sensitization factors of silver halide grains, and the minimum latent image size.

With the intention of increasing the light absorption factor of silver halide grains, number of arts as described below have so far been proposed.

For instance, the art of tabular emulsion grains having a high aspect ratio as disclosed in U.S. Pat. No. 5,494,789 enables an increase in the quantity of dye adsorption per grain through an increase of grain surface area; as a result, an increase in the light absorption factor becomes possible. There is however a limit to the increase in grain surface area by the heightening of aspect ratio, and so the increase in light absorption factor per grain requires an increase of grain size also.

Other examples of a method for increasing the per grain surface area include the method of making holes in a certain part of each grain as described in JP-A-58-106532 and JP-A-60-221320 (The term "JP-A" as used herein means an "unexamined published Japanese patent application") and the method of forming ruffled grains as described in U.S. Pat. No. 4,643,966. However, the grains according to those methods have unstable forms, so that it is quite difficult to put them to practical use.

In addition, U.S. Pat. No. 5,302,499 discloses an increase in light absorption factor by the formation of a layer structure which can optimize the spectral sensitization characteristics and the grain thickness. However, the increase in light absorption factor by such a method is of the order of 10% at the greatest.

On the other hand, it is thought that the light absorption factor of sensitizing dyes are increased to promote the efficiency in transferring the energy of light to silver halide; as a result, the heightening of spectral sensitivities is achieved.

However, there is a limit to the quantity of sensitizing dyes adsorbed to the surfaces of silver halide grains, and it is difficult to make sensitizing dyes be adsorbed to the grain surfaces in a quantity greater than that required for saturating the grain surfaces with the sensitizing dyes adsorbed in a monolayer. Accordingly, the absorption factor of the photons incident upon each silver halide grain in the spectrally sensitized region is very low under the present conditions.

The methods proposed for solving the aforementioned problems are described below:

The adsorption of a cationic dye as the first layer and an anionic dye as the second layer through th e electrostatic force of attraction was proposed by P. B. Gilman, Jr. et al. in *Photographic Science and Engineering*, vol. 20, No. 3, p. 97 (1976).

The method proposed by G. B. Bird et al. in U.S. Pat. No. 3,622,316 consists in that the silver halide adsorbed by a plurality of dyes in a multilayer is sensitized through the contribution of the excitation energy transfer of Forster type.

The spectral sensitization through energy transfer from luminescent dyes was proposed by Sugimoto et al. in JP-A-63-138341 and JP-A-64-84244.

R. Steiger et al. tried the spectral sensitization through energy transfer from gelatin-substituted cyanine dyes in *Photographic Science and Engineering*, vol. 27, No.2, p. 59 (1983).

Ikegawa et al. carried out the spectral sensitization through energy transfer from cyclodextrin-substituted dyes in JP-A-61-251842.

The dyes in which two separate chromophores are coupled via covalent bonds without forming a conjugated system, or the so-called coupled dyes, are described, e.g., in U.S. Pat. Nos. 2,393,351, 2,425,772, 2,518,732, 2,521,944 and 2,592,196, and European Patent No. 565,083. Therein, however, those dyes did not make it their aim to heighten the light absorption factor. With respect to the dyes with a positive aim of increasing the light absorption factor, G. B. Bird, A. L. Borror, et al. disclose in U.S. Pat. Nos. 3,622,317 and 3,976,493 the sensitizing dyes of the coupled dye type which have a plurality of cyanine chromophores in a molecule, and therein the increase of the light absorption factor by adsorption of those dyes and the resultant sensitization through contribution of the energy transfer are proposed. Also, Ukai, Okazaki and Sugimoto proposed in JP-A-64-91134 the binding of at least one substantially non-adsorptive dye having at least two sulfo and/or carboxyl groups to a spectral sensitizing dye capable of being adsorbed to silver halide grains.

In addition, M. R. Roberts et al. proposed in U.S. Pat. No. 4,959,587 the spectral sensitization by the use of cyanine dye polymers.

As mentioned above, many proposals have been advanced on the method of increasing the light absorption factor, but all of them are insufficient in sensitivity heightening effect and attended by problems of causing an increase in intrinsic desensitization, retarding the development and so on.

Thus, novel spectral sensitization arts which enable the sensitivity to be heightened through an increase in the light absorption factor of silver halide photographic materials have been searched for.

The silver halide-utilized photographic materials have underwent a growing development in recent years; as a result, color images of high quality can be obtained simply and easily at present. Even now, the proposal of improved arts is continued in large number. In particular, various arts of using the so-called high silver chloride content grains having a high silver chloride content (more specifically, the term "high silver chloride content grains" as used hereinafter refers to the grains having a silver chloride content of no lower than 50%) have been proposed with the intention of simplifying and speeding up the development-processing. The use of high silver chloride content grains has advantages in that it can increase the developing speed, heighten the reusability of processing solutions, and so on. Therefore, the sensitive materials of the type which use high silver chloride content grains now came to prevail among the sensitive materials for printing use, including color photographic printing paper.

The high silver chloride content grains have a tendency to become grains having (100) faces as their outer surfaces (hereinafter referred to as "(100) grains") when they are formed under ordinary condition, and practically used grains also have a cubic crystal shape. In recent years, (100) grains having tabular crystal shapes have also been developed, and they have advantages, e.g., in that they can undergo effective spectral sensitization and provide a great covering power after development because of their great specific surface area (the surface area/volume ratio). Such tabular grains are disclosed, e.g., in U.S. Pat. Nos. 5,320,938, 5,264,337 and 5,292,632.

However, (100) high silver chloride content grains had a drawback of tending to be fogged, compared with silver bromide grains of common use. In order to remedy this drawback, the grains having a high silver chloride content and (111) faces as their outer surfaces (hereinafter referred to as "(111) high silver chloride content grains") were used. For instance, the use of such grains is disclosed in JP-A-6-138619.

The production of (111) high silver chloride content grains requires special measures. For instance, Wey discloses in U.S. Pat. No. 4,399,215 the method of producing tabular high silver chloride content grains in the presence of ammonia. According to this method, it is difficult to produce grains having sizes small enough to be used practically. This is because the use of ammonia compels silver chloride grains, which originally have high solubility, to be produced under a condition that their solubility is further heightened. In addition, the foregoing method has a disadvantage in that the grains are produced under a high pH condition (pH 8–10) to have a tendency to be fogged. Maskasky discloses in U.S. Pat. No. 5,061,617 the (111) high silver chloride content grains produced in the presence of thiocyanates. Similarly to ammonia, the thiocyanates increase the solubility of silver chloride. For the purpose of forming the high silver chloride content grains having (111) faces as outer surfaces without heightening the solubility, the methods of using additives (crystal habit control agent) during the grain formation are known. The following are examples of such a method:

| Patent gazette | Crystal habit control agent | Inventor |
|---|---|---|
| U.S. Pat. No. 4,400,463 | azaindenes + thioether peptizer | Maskasky |
| U.S. Pat. No. 4,783,398 | 2,4-dithiazolidinone | Mifune et al. |
| U.S. Pat. No. 4,713,323 | aminopyrazolopyrimidine | Maskasky |
| U.S. Pat. No. 4,983,508 | bispyridinium salt | Ishiguro et al. |
| U.S. Pat. No. 5,185,239 | triaminopyridine | Maskasky |
| U.S. Pat. No. 5,178,997 | 7-azaindole compounds | Maskasky |
| U.S. Pat. No. 5,178,998 | xanthin | Maskasky |
| JP-A-64-70741 | dyes | Nishikawa et al. |
| JP-A-3-212639 | aminothiol | Ishiguro |
| JP-A-4-283742 | thiourea derivatives | Ishiguro |
| JP-A-4-335632 | triazolium salts | Ishiguro |
| JP-A-8-227117 | monopyridinium salts | Ozeki et al. |

Although the development of techniques has been progressed as mentioned above, the crystal habit control agent used during the grain formation is known to remain on the grain surface after the grain formation, thereby inhibiting the adsorption of spectral sensitizing dyes to the grain surface. Accordingly, spectral sensitizing dyes which are weak in adsorbing power cannot confer sufficient spectral sensitivities upon the grains.

As a means to make up for the spectral sensitivities, the method of using streptocyanine dyes has hitherto been known. These dyes can adsorb in a large quantity because of their small adsorption area per molecule; as a result, the light absorption factor per emulsion grain can be improved. For instance, such a method is disclosed in JP-A-9-127637. However, the dyes used therein cannot ensure a satisfactory rise in spectral sensitization efficiency although they can increase the quantity of absorbed light. Therefore, it has been desired to introduce improvements in the foregoing method in the case of silver chloride grains which are weak in dye adsorbing power, especially the grains formed using a crystal habit control agent.

SUMMARY OF THE INVENTION

A first object of the present invention is to provide a silver halide photographic material having high sensitivity.

A second object of the present invention is to provide a silver halide photographic material which can be processed easily and rapidly and reduced in pollution removal loads and generation of fog.

A third object of the present invention is to provide a high-speed silver halide emulsion having excellent spectral sensitization characteristics.

As a result of our intensive studies, it has been found that the foregoing objects can be attained with the methods illustrated below.

More specifically, it has been found that the first object of the present invention can be achieved by the following embodiment (1), (2), (3) or (4):

(1) A silver halide photographic material comprising a support having provided thereon an emulsion layer, with the emulsion layer comprising silver halide grains having an aspect ratio within the range of 3 to 100 and at least one compound represented by the following formula (I) or (II):

(I)

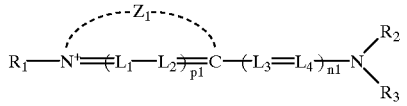

$M_1m_1$ wherein $Z_1$ represents atomic groups required for forming a 5- or 6-membered nitrogen-containing heterocyclic ring, $R_1$, $R_2$ and $R_3$ each represents an alkyl group, an aryl group or a heterocyclic group, $L_1$, $L_2$, $L_3$ and $L_4$ each represents a methine group, $n_i$ represents 0, 1, 2, 3 or 4, $P_1$ represents 0 or 1, $M_1$ represents a counter ion for adjusting the balance of charge, and $m_1$ represents the number of counter ions required for neutralizing the charges in a molecule, which is from 0 to 10;

(II)

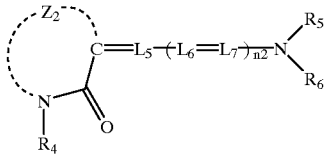

$M_2m_2$ wherein $Z_2$ represents atomic groups required for completing an acidic nucleus, $R_4$, $R_5$ and $R_6$ each represents an alkyl group, an aryl group or a heterocyclic group, $L_5$, $L_6$ and $L_7$ each represents a methine group, $n_2$ represents 0, 1, 2, 3 or 4, $M_2$ represents a counter ion for adjusting the balance of charge, and $m_2$ represents the number of counter ions required for neutralizing the charges in a molecule, which is from 0 to 10.

(2) The silver halide photographic material as described in the aforesaid embodiment (1), wherein the compound represented by formula (I) is a compound selected from the compounds represented by the following formula (III) and the compound represented by formula (II) is a compound selected from the compounds represented by the following formula (IV):

(III)

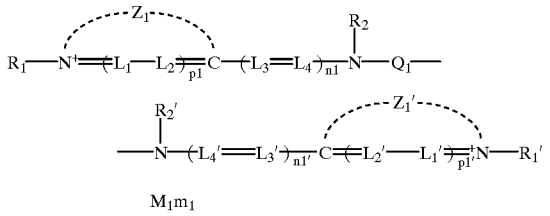

$M_1m_1$ wherein $Q_1$ represents a divalent linking group or a single bond, $Z_1$, $R_1$, $R_2$, $L_1$, $L_2$, $L_3$, $L_4$, $p_1$, $n_1$, $M_1$ and $m_1$ have the same meanings as in formula (I) respectively, and $Z_1'$, $R_1'$, $R_2'$, $L_1'$, $L_2'$, $L_3'$, $L_4'$, $p_1'$ and $n_1'$ have the same meanings as $Z_1$, $R_1$, $R_2$, $L_1$, $L_2$, $L_3$, $L_4$, $p_1$ and $n_1$ respectively;

(IV)

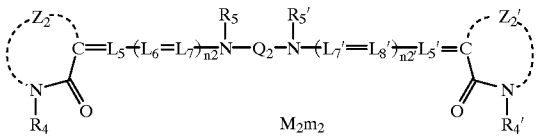

$M_2m_2$ wherein $Q_2$ represents a divalent linking group or a single bond, $Z_2$, $R_4$, $R_5$, $L_5$, $L_6$, $L_7$, $n_2$, $M_2$ and $m_2$ have the same meanings as in formula (II) respectively, and $Z_2'$, $R_4'$, $R_5'$, $L_5'$, $L_6'$, $L_7'$ and $n_2'$ have the same meanings as $Z_2$, $R_4$, $R_5$, $L_5$, $L_6$, $L_7$, and $n_2$ respectively.

(3) The silver halide photographic material as described in the embodiment (1) or (2), wherein the aspect ratio of the silver halide grains is from 3 to 50.

(4) The silver halide photographi c material as described in the embodiment (1) or (2), wherein the aspect ratio of the silver halide grains is from 5 to 50.

Further, it has been found that the second object and the third object of the present invention can be achieved by the following embodiment (5), (6), (7) or (8):

(5) A silver halide photographic material comprising a support having provided thereon at least one light-sensitive silver halide emulsion layer, with the emulsion layer comprising at least one compound represented by the formula (I) or (II) defined in the aforesaid embodiment (1) and silver halide grains at least 50%, based on projected area, of which are grains having a silver chloride content of at least 50 mole % and an outer surface at least 50% of which is constituted of (111) faces.

(6) The silver halide photographic material as described in the aforesaid embodiment (5), wherein the silver halide grains are formed in the presenc e of at least one compound selected from the compounds represented by the following formula (V), (VI) or (VII):

(V)

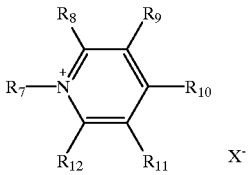

wherein $R_7$ represents an alkyl group, an alkenyl group or an aralkyl group, $R_8$, $R_9$, $R_{10}$, $R_{11}$ and $R_{12}$ each represents a hydrogen atom or a substituent group, or a condensed ring may be formed by combining $R_8$ with $R_9$, $R_9$ with $R_{10}$, $R_{10}$ with $R_{11}$, or $R_{11}$ with $R_{12}$, provided that at least one of the substituent groups $R_8$ to $R_{12}$ represents an aryl group, and $X^-$ represents a counter anion;

(VI)

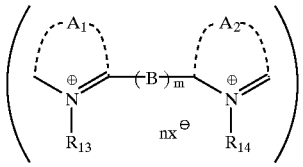

(VII)

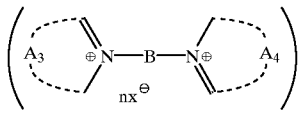

wherein $A_1$, $A_2$, $A_3$ and $A_4$, which may be the same or different, each represents a non-metal atomic group required for completing a nitrogen-containing heterocyclic ring, B represents a divalent linking group, m represents 0 or 1, $R_{13}$ and $R_{14}$ each represents an alkyl group, X represents an anion, and n represents 0 or 1, but n is 0 when the compound forms an inner salt.

(7) The silver halide photographic material as described in the foregoing embodiment (5), wherein the silver halide grains comprises tabular grains having an aspect ratio of at least 5 and (111) faces as their main outer surface.

(8) The silver halide photographic material as described in the foregoing embodiment (5), wherein the compound represented by the formula (I) is a compound selected from the compounds represented by the formula (III) defined in the foregoing embodiment (2) and the compound represented by the formula (II) is a compound selected from the compounds represented by the formula (IV) defined in the foregoing embodiment (2).

DETAILED DESCRIPTION OF THE INVENTION

The compounds used in the present invention are illustrated below in detail.

Examples of a 5- or 6-membered nitrogen-containing heterocyclic ring represented by $Z_1$ and $Z_1'$ each in formulae (I) and (III) include a thiazoline nucleus, a thiazole nucleus, a benzothiazole nucleus, an oxazoline nucleus, an oxazole nucleus, a benzoxazole nucleus, a selenazoline nucleus, a selenazole nucleus, a benzoselenazole nucleus, a 3,3-dialkylindolenine nucleus (e.g., 3,3-dimethylindolenine), an imidazoline nucleus, an imidazole nucleus, a benzoimidazole nucleus, a pyrroline nucleus, a 2-pyridine nucleus, a 4-pyridine nucleus, a 2-quinoline nucleus, a 4-quinoline nucleus, a 1-isoquinoline nucleus, a 3-isoquinoline nucleus, an imidazo[4,5-b]quinoxaline nucleus, an oxadiazole nucleus, a thiadiazole nucleus, a tetrazole nucleus and a pyrimidine nucleus.

Desirably, the heterocyclic ring represented by $Z_1$ and $Z_1'$ each is an oxazoline nucleus, an oxazole nucleus, a benzoxazole nucleus, a thiazoline nucleus, a thiazole nucleus, a benzothiazole nucleus, an imidazoline nucleus, an imidazole nucleus, a benzoimidazole nucleus or a pyrroline nucleus. Of these nuclei, an oxazoline nucleus, a thiazoline nucleus, an imidazoline nucleus and a pyrroline nucleus are preferred over the others. In particular, an imidazoline nucleus is advantageous.

p and p' are each 0 or 1, preferably 1.

When the letter V is used to designate a substituent which may be present on $Z_1$ and $Z_1'$ each, V has no particular restriction, with examples including a halogen atom (e.g., chlorine, bromine, iodine, fluorine), a mercapto group, a cyano group, a carboxyl group, a phosphoric acid group, a sulfo group, a hydroxyl group, a carbamoyl group containing 1 to 10, preferably 2 to 8, particularly preferably 2 to 5, carbon atoms (e.g., methylcarbamoyl, ethylcarbamoyl, morpholinocarbamoyl), a sulfamoyl group containing 0 to 10, preferably 2 to 8, particularly preferably 2 to 5, carbon atoms (e.g., methylsulfamoyl, ethylsulfamoyl, piperidinosulfonyl), a nitro group, an alkoxy group containing 1 to 20, preferably 1 to 10, particularly preferably 1 to 8, carbon atoms (e.g., methoxy, ethoxy, 2-methoxyethoxy, 2-phenylethoxy), an aryloxy group containing 6 to 20, preferably 6 to 12, particularly preferably 6 to 10, carbon atoms (e.g., phenoxy, p-methylphenoxy, p-chlorophenoxy, naphthoxy), an acyl group containing 1 to 20, preferably 2 to 12, particularly preferably 2 to 8, carbon atoms (e.g., acetyl, benzoyl, trichloroacetyl), an acyloxy group containing 1 to 20, preferably 2 to 12, particularly preferably 2 to 8, carbon atoms (e.g., acetyloxy, benzoyloxy), an acylamino group containing 1 to 20, preferably 2 to 12, particularly preferably 2 to 8, carbon atoms (e.g., acetylamino), a sulfonyl group containing 1 to 20, preferably 1 to 10, particularly preferably 1 to 8, carbon atoms (e.g., methanesulfonyl, ethanesulfonyl, benzenesulfonyl), a sulfinyl group containing 1 to 20, preferably 1 to 10, particularly preferably 1 to 8, carbon atoms (e.g., methanesulfinyl, benzenesulfinyl), a sulfonylamino group containing 1 to 20, preferably 1 to 10, particularly preferably 1 to 8, carbon atoms (e.g., methanesulfonylamino, ethanesulfonylamino, benzenesulfonylamino), an amino group, a substituted amino group containing 1 to 20, preferably 1 to 12, particularly preferably 1 to 8, carbon atoms (e.g., methylamino, dimethylamino, benzylamino, anilino, diphenylamino), an ammonium group containing 0 to 15, preferably 3 to 10, particularly preferably 3 to 6, carbon atoms (e.g., trimethylammonium, triethylammonium), a hydrazino group containing 0 to 15, preferably 1 to 10, particularly preferably 1 to 6, carbon atoms (e.g., trimethylhydrazino), an ureido group containing 1 to 15, preferably 1 to 10, particularly preferably 1 to 6, carbon atoms (e.g., ureido, N,N-dimethylureido), an imino group containing 1 to 15, preferably 1 to 10, particularly preferably 1 to 6, carbon atoms (e.g., succinimido), an alkylthio group containing 1 to 20, preferably 1 to 12, particularly preferably 1 to 8, carbon atoms (e.g., methylthio, ethylthio, carboxyethylthio, sulfobutylthio), an arylthio group containing 6 to 20, preferably 6 to 12, particularly preferably 6 to 8, carbon atoms (e.g., phenylthio), an alkoxycarbonyl group containing 2 to 20, preferably 2 to 12, particularly preferably 2 to 8, carbon atoms (e.g., methoxycarbonyl, ethoxycarbonyl, benzyloxycarbonyl), an aryloxycarbonyl group containing 6 to 20, preferably 6 to 12, particularly preferably 6 to 8, carbon atoms (e.g., phenoxycarbonyl), an unsubstituted alkyl group containing 1 to 18, preferably 1 to 10, particularly preferably 1 to 5, carbon atoms (e.g., methyl, ethyl, propyl, butyl), a substituted alkyl group containing 1 to 18, preferably 1 to 10, particularly preferably 1 to 5, carbon atoms (e.g., hydroxymethyl, trifluoromethyl, benzyl, carboxyethyl, ethoxycarbonylmethyl, acetylaminomethyl, and the term "substituted alkyl group" as used herein is intended to include unsaturated hydrocarbon groups containing 2 to 18, preferably 3 to 10, particularly preferably 3 to 5, carbon atoms, such as vinyl, ethinyl, 1-cyclohexenyl, benzylidyne and benzylidine groups), a substituted or unsubstituted aryl group containing 6 to 20, preferably 6 to 15, particularly preferably 6 to 10, carbon atoms (e.g., phenyl, naphthyl, p-carboxyphenyl, p-nitrophenyl, 3,5-dichlorophenyl, p-cyanophenyl, m-fluorophenyl, p-tolyl), and a heterocyclic group containing 1 to 20, preferably 2 to 10, particularly preferably 4 to 6, carbon atoms which may be substituted (e.g., pyridyl, 5-methylpyridyl, thienyl, furyl, morpholino, tetrahydrofurfuryl). In addition, the substituent group V on the heterocyclic ring can be atomic groups completing a benzene-, naphthalene- or anthracene-condensed ring. Further, the groups as recited above may be substituted with V.

Of those groups, the foregoing alkyl, aryl, alkoxy, halogen, acyl, cyano, sulfonyl and atomic groups completing a benzene-condensed rings are desirable for the substituent on $Z_1$ or $Z_1'$. Further, the foregoing alkyl, aryl, halogen, acyl, sulfonyl and atomic groups completing a benzene-condensed ring are preferable. In particular, a methyl group, a phenyl group, a methoxy group, a chlorine atom, a bromine atom, an iodine atom and atomic groups completing a benzene-condensed ring are advantageous. The most suitable substituents are a phenyl group, a chlorine atom, a bromine atom and an iodine atom.

The methine group represented by $L_1$, $L_2$, $L_1'$ and $L_2'$ each may have a substituent. Examples of such a substituent include the groups recited above as examples of V. Preferably, $L_1$, $L_2$, $L_1'$ and $L_2'$ are each an unsubstituted methine group.

Each of $Q_1$ and $Q_2$ in formulae (III) and (IV) respectively is a divalent linking group or a single bond, preferably a divalent linking group. The divalent linking group is an atom or atomic groups preferably including at least one carbon, nitrogen, sulfur or oxygen atom. Suitable examples of such a divalent linking group include an alkylene group (e.g., methylene, ethylene, propylene, butylene, pentylene), an alkenylene group (e.g., ethenylene, propenylene), an alkynylene group (e.g., ethynylene, propynylene), an amido group, an ester group, a sulfonamido group, a sulfonate group, an ureido group, a sulfonyl group, a sulfamoyl group, a thioether group, an ether group, a carbonyl group, —N(Ra)—(wherein Ra represents a hydrogen atom, a substituted or unsubstituted alkyl group, or a substituted or unsubstituted aryl group), a divalent heterocyclic group (e.g., 6-chloro-1,3,5-triazine-2,4-diyl, pyrimidine-2,4-diyl, quinoxaline-2,3-diyl) and a divalent group containing 1 to 20 carbon atoms which is formed by combining two or more of the above-recited groups. These divalent linking groups each may have a substituent. Examples of such a substituent include the groups recited above as examples of V.

Of those groups, alkylene groups containing 1 to 4 carbon atoms (e.g., methylene, ethylene, propylene, butylene), arylene groups containing 6 to 10 carbon atoms (e.g., phenylene, naphthylene), alkenylene containing 1 to 4 carbon atoms (e.g., ethenylene, propenylene), alkynylene group containing 1 to 4 carbon atoms (e.g., ethynylene, propynylene) and a divalent linking group containing 1 to 10 carbon atoms by combining two or more of the above-recited ones are preferred over the others.

Each of the substituent groups $R_1$, $R_2$, $R_3$, $R_4$, $R_5$, $R_6$, $R_1'$, $R_2'$, $R_4'$ and $R_5'$ in formulae (I), (II), (III) and (IV) represents an alkyl group, an aryl group or a heterocyclic group. Examples of such an alkyl group include an unsubstituted alkyl group containing 1 to 18, preferably 1 to 7, particularly preferably 1 to 4, carbon atoms (e.g., methyl, ethyl, propyl, isopropyl, butyl, isobutyl, hexyl, octyl, dodecyl, octadecyl) and substituted alkyl groups containing 1 to 18, preferably 1 to 7, particularly preferably 1 to 4, carbon atoms [e.g., alkyl groups substituted with V which can be present as a substituent on the foregoing $Z_1$ and the like, preferably including an aralkyl group (e.g., benzyl, 2-phenylethyl), an unsaturated hydrocarbon group (e.g., allyl), a hydroxyalkyl group (e.g., 2-hydroxyethyl, 3-hydroxypropyl), a carboxyalkyl group (e.g., 2-carboxyethyl, 3-carboxypropyl, 4-carboxybutyl, carboxymethyl), an alkoxyalkyl group (e.g., 2-methoxyethyl, 2-(2-methoxyethoxy)ethyl), an aryloxyalkyl group (e.g., $^2$-phenoxyethyl, 2-(l-naphthoxy)ethyl), an alkoxycarbonylalkyl group (e.g., ethoxycarbonylmethyl, 2-benzyloxycarbonylethyl), an aryloxycarbonylalkyl group (e.g., 3-phenoxycarbonylpropyl), an acyloxyalkyl group (e.g., 2-acetyloxyethyl), an acylalkyl group (e.g., 2-acetylethyl), a carbamoylalkyl group (e.g., 2-morpholinocarbonylethyl), a sulfamoylalkyl group (e.g., N,N-dimethylcarbamoylmethyl), a sulfoalkyl group (e.g., 2-sulfoethyl, 3-sulfopropyl, 3-sulfobutyl, 4-sulfobutyl, 2-(3-sulfopropoxy)ethyl, 2-hydroxy-3-sulfopropyl, 3-sulfopropoxyethoxyethyl), a sulfoalkenyl group (e.g., sulfopropenyl), a sulfatoalkyl group (e.g., 2-sulfatoethyl, 3-sulfatopropyl, 4-sulfatobutyl), an alkyl group substituted with a heterocyclic group (e.g., 2-(pyrrolidine-2-one-yl) ethyl, tetrahydrofurfuryl) and an alkylsulfonylcarbamoylmethyl group (e.g., methanesulfonylcarbamoylmethyl)].

Examples of the foregoing aryl group include an unsubstituted aryl group containing 6 to 20, preferably 6 to 10, particularly preferably 6 to 8, carbon atoms (e.g., phenyl, 1-naphthyl) and substituted aryl groups containing 6 to 20, preferably 6 to 10, particularly preferably 6 to 8 carbon atoms (e.g., aryl groups substituted with V which can be present as a substituent on the foregoing $Z_1$ and the like, specifically including p-methoxyphenyl, p-methylphenyl, p-chlorophenyl and so on).

Examples of the foregoing heterocyclic group include an unsubstituted heterocyclic group containing 1 to 20, preferably 3 to 10, particularly preferably 4 to 8, carbon atoms (e.g., 2-furyl, 2-thiethyl, 2-pyridyl, 3-pyrazolyl, 3-isoxazolyl, 3-iso-thiazolyl, 2-imidazolyl, 2-oxazolyl, 2-thiazolyl, 2-pyridazinyl, 2-pyrimidyl, 3-pyrazyl, 2-(1,3,5-triazolyl), 3-(1,2,4-triazolyl), 5-tetrazolyl) and substituted heterocyclic groups containing 1 to 20, preferably 3 to 10, particularly preferably 4 to 8, carbon atoms (e.g., heterocyclic groups substituted with V which can be-present as a substituent on the foregoing $Z_1$ and the like, specifically including 5-methyl-2-thienyl, 4-methoxy-2-pyridyl group and so on).

The group suitable for $R_1$ and $R_1'$ each is an alkyl group, preferably a carboxyalkyl, sulfoalkyl or unsubstituted alkyl group as recited above, especially preferably a sulfoalkyl or unsubstituted alkyl group as recited above.

The group preferred as $R_2$, $R_3$, $R_4$, $R_5$, $R_6$, $R_2'$, $R_4'$ and $R_5'$ each is an unsubstituted alkyl, sulfoalkyl, carboxyalkyl, unsubstituted aryl or unsubstituted heterocyclic group as recited above, especially methyl, ethyl, 2-sulfoethyl, 3-sulfopropyl, 3-sulfobutyl, 4-sulfobutyl, carboxymethyl, phenyl, 2-pyridyl or 2-thiazolyl group.

In addition, $R_2$ or $R_5$ can combine with $R_2'$ or $R_5'$ respectively to form the same divalent linking group as represented by the foregoing $Q_1$ and $Q_2$ each.

Further, $R_3$ and $R_6$ may be substituted with methine compounds necessary for the formation of compounds represented by formulae (III) and (IV) respectively.

$Z_2$ and $Z_2'$ in formulae (II) and (IV) each represents atomic groups completing an acidic nucleus, and the acidic nucleus completed thereby can be any of the acidic nuclei contained in general merocyanine dyes. The term acidic nuclei used herein is intended to include those defined in, e.g., *The Theory of The Photographic Process*, page 198, 4th edition edited by T. H. James, published in 1977 by Macmillan Publishing Co., Inc. Examples of such acidic nuclei are described, e.g., in U.S. Pat. Nos. 3,567,719, 3,575,869, 3,804,634, 3,837,862, 4,002,480 and 4,925,777, and JP-A-3-167546.

It is desirable for the acidic nuclei of the compounds for use in the present invention to form 5- or 6-membered heterocycles which are constituted of carbon, nitrogen and chalcogen atoms (the term chalcogen typically includes oxygen, sulfur, selenium and tellurium).

Examples of acidic nuclei suitable for the compounds for use in the present invention include the nuclei of 2-pyrazoline-5-one, pyrazolidine-3,5-dione, imidazoline-5-one, hydantoin, 2- or 4-thiohydantoin, 2-iminooxazolidine-4-one, 2-oxazoline-5-one, 2-thiooxazolidine-2,4-dione, isooxazoline-5-one, 2-thiazoline-4-one, thiazolidine-4-one, thiazolidine-2,4-dione, rhodanine, thiazolidine-2,4-dithione, isorhodanine, indane-1,3-dione, thiophene-3-one, thiophene-3-one-1,1-dioxide, indoline-2-one, indoline-3-one, 2-oxoindazolium, 3-oxoindazolium, 5,7-dioxo-6,7-dihydrothiazolo[3,2-a]pyrimidine, cyclohexane-1,3-dione, 3,4-dihydroisoquinoline-4-one, 1,3-dioxane-4,6-dione, barbituric acid, 2-thiobarbituric acid, chroman-2,4-dione, indazoline-2-one, pyrido[1,2-a]pyrimidine-1,3-dione, pyrazolo[1,5-b]quinazolone, pyrazolo[1,5-b]benzimidazole, pyrazolopyridone, 1,2,3,4-tetrahydroquinoline-2,4-dione, 3-oxo-2, 3-dihydrobenzo[d]thiophene-1,1-dioxide and 3-dicyanomethine-2,3-dihydrobenzo[d]thiophene-1,1-dioxide.

The acidic nucleus preferred as $Z_2$ and $Z_2'$ each is a hydantoin, 2- or 4-thiohydantoin, 2-oxazoline-5-one, 2-thiooxazoline-2,4-dione, thiazolidine-2,4-dione, rhodanine, thiazolidine-2,4-dione, barbituric acid or 2-thiobarbituric acid nucleus, especially a hydantoin, 2- or 4-thiohydantoin, 2-oxozoline-5-one, rhodanine, barbituric acid or 2-thiobarbituric acid nucleus. Of these nuclei, 2- or 4-thiohydantoin, 2-oxazoline-5-one and rhodanine nuclei are favorable over the others.

$L_3$, $L_4$, $L_5$, $L_6$, $L_7$, $L_3'$, $L_4'$, $L_6$ and $L_7'$ in formulae (I), (II), (III) and (IV) are independent of one another, and each represents a methine group which may have a substituent. Examples of such a substituent include a substituted or unsubstituted alkyl group containing 1 to 15, preferably 1 to 10, particularly preferably 1 to 5, carbon atoms (e.g., methyl, ethyl, 2-carboxyethyl), a substituted or unsubstituted aryl group containing 6 to 20, preferably 6 to 15, particularly preferably 6 to 10, carbon atoms (e.g., phenyl, o-carboxyphenyl), a substituted or unsubstituted heterocyclic group containing 3 to 20, preferably 4 to 15, particularly preferably 6 to 10, carbon atoms (e.g., N,N-diethylbarbituric acid), a halogen atom (e.g., chlorine, bromine, fluorine, iodine), an alkoxy group containing 1 to 15, preferably 1 to 10, particularly preferably 1 to 5, carbon atoms (e.g., methoxy, ethoxy), an alkylthio group containing 1 to 15, preferably 1 to 10, particularly preferably 1 to 5, carbon atoms (e.g., methylthio, ethylthio), an arylthio group containing 6 to 20, preferably 6 to 15, particularly preferably 6 to 10, carbon atoms (e.g., phenylthio) and an amino group-containing 0 to 15, preferably 2 to 10, particularly preferably 4 to 10, carbon atoms (e.g., N,N-diphenylamino, N-methyl-N-phenylamino, N-methylpiperazino). Further, those methine groups each may form a ring by combining with another methine group, or one of the auxochromes $Z_1$, $Z_2$, $Z_1'$ and $Z_2'$, or one of the substituent groups on those auxochromes, $R_1$, $R_2$, $R_4$, $R_4$, $R_5$, $R_6$, $R_1'$, $R_2'$, $R_4$ and $R_5'$, or $Q_2$.

It is desirable for $n_1$, $n_2$, $n_1'$ and $n_2'$ each to be 0, 1, 2 or 3. Each of them is preferably 0, 1 or 2, particularly preferably 2. When $n_1$, $n_2$, $n_1'$ and $n_2'$ are each 2 or more, it is unnecessary for the methine groups repeated to be the same.

$M_1$ and $M_2$ are contained in formula (I) or (III) and formula (II) or (IV) respectively in order to indicate the presence of cations or anions required for neutralizing the ionic charge of each dye moiety. Typical examples of such a cation include a hydrogen ion, inorganic cations, such as an alkali metal ion (e.g., sodium, potassium or lithium ion) and an alkaline earth metal ion (e.g., calcium ion), and organic cations such as an ammonium ion (e.g., ammonium, tetraalkylammonium, pyridinium or ethylpyridinium ion). Also, such an anion may include both inorganic and organic ones. As examples thereof, mention may be made of a halogen anion (e.g., fluorine, chlorine or iodine ion), a substituted arylsulfonic acid ion (e.g., p-toluenesulfonic acid or p-chlorobenzenesulfonic acid ion), an aryldisulfonic acid ion (e.g, 1,3-benzenedisulfonic acid, 1,5-naphthalenedisulfonic acid or 2,6-naphthalenedisulfonic acid ion), an alkylsulfuric acid ion (e.g., methylsulfuric acid ion), a sulfuric acid ion, a thiocyanic acid ion, a perchloric acid ion, a tetrafluoroboric acid ion, a picric acid ion, acetic acid ion and a trifluoromethanesulfonic acid ion. In addition, $M_1$ and $M_2$ each may be an ionic polymer or another dye having the charge opposite to that of the dye moiety.

Additionally, the present invention uses $SO_3^-$ as the notation of a sulfo group, but a sulfo group can also be denoted by $SO_3H$ when it has a hydrogen ion as its counter ion.

$m_1$ and $m_2$ each represents the number of ions required for adjusting the balance of electric charge. In a case where an inner salt is formed, such a number is 0.

Examples of the compounds represented by formulae (I), (II), (III) and (IV) are illustrated below, but these examples should not be construed as limiting on or determinative of the scope of the present invention.

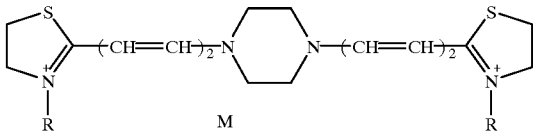

(1); R = $CH_2CO_2H$, M = $2I^-$ (2); R = $(CH_2)_3SO_3^-$, M = no ion

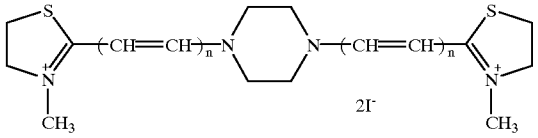

(3); n = 1

(4); n = 3

(5)

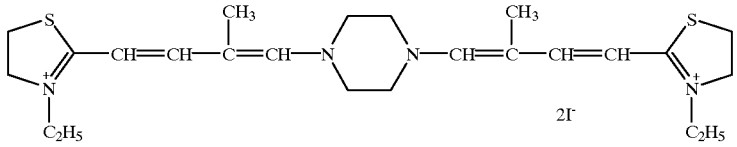

(6)

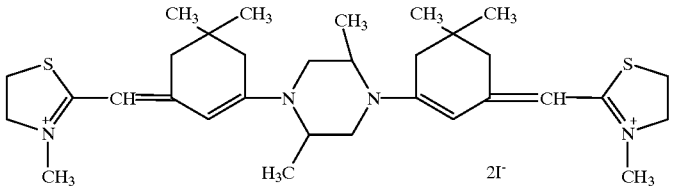

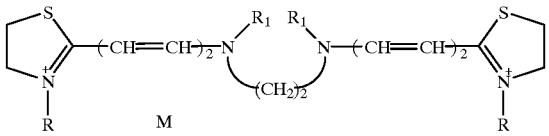

-continued
(7); R = $CH_3$, $R_1$ = $CH_3$, M = $2I^-$
(8); R = $CH_3$, $R_1$ = $—CH_2CO_2^-$, M = no ion
(9); R = $CH_3$, $R_1$ = $—(CH_2)_2SO_3^-$, M = no ion
(10); $R_1$ = $—(CH_2)_3SO_3^-$, $R_1$ = $—(CH_2)_2SO_3^-$, M = $2Na^+$
(11)
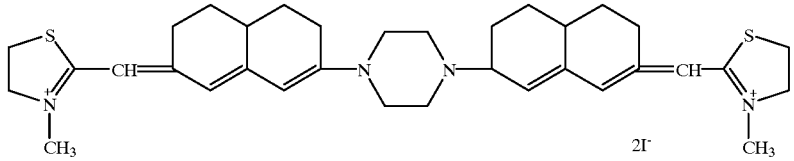
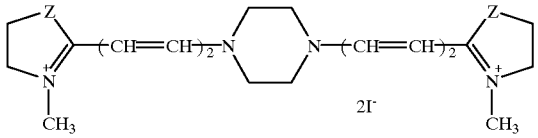
(12); Z = O
(13); Z = Se
(14); Z = N—$(CH_2)_2OH$
(15); Z = $CH_2$
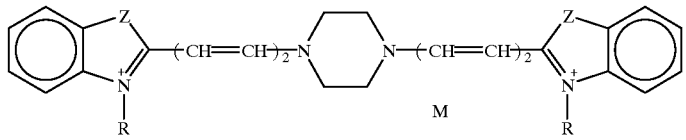
(16); Z = S, R = $CH_3$, M = $2I^-$
(17); Z = O, R = $(CH_2)_4SO_3^-$, M = no ion
(18); Z = N—$C_2H_5$, R = $CH_2CONHSO_2CH_3$, M = $2Cl^-$
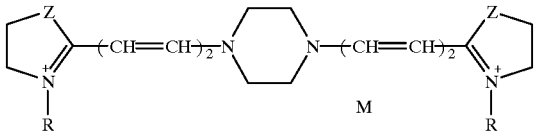
(19); Z = O, R = $CH_3$, M = $2I^-$
(20); Z = S, R = $CH_3$, M = $2I^-$
(21); Z = N—$CH_3$, R = $—(CH_2)_3SO_3^-$, M = no ion
(22); Z = Se, R = $CH_2CO_2H$, M = $2Br^-$
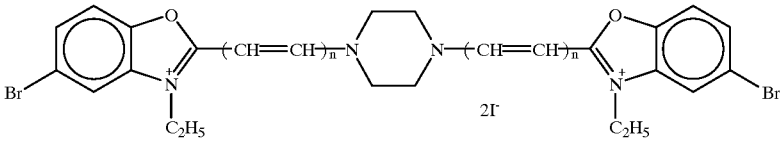
(23); n = 1
(24); n = 2
(25); n = 3

-continued
(26)
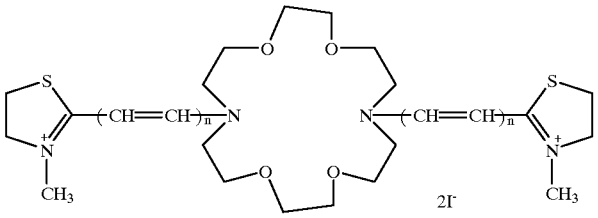
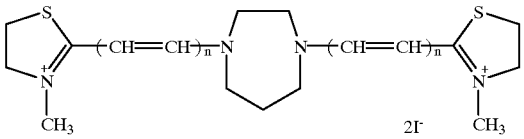
(27); n = 1
(28); n = 2
(29); n = 3
(30)
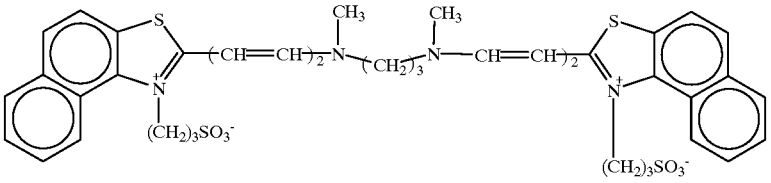
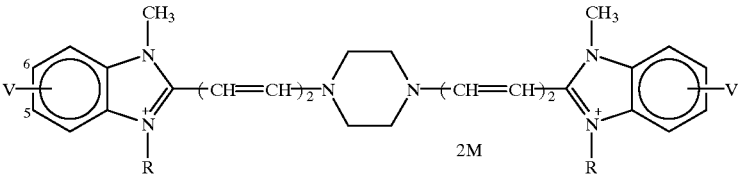
(31) V = 5, 6-$Cl_2$, R = $CH_3$, M = $I^-$
(32) V = 5-Cl, R = $CH_3$, M = $I^-$
(33) V = 5-CN, R = $C_2H_5$, M = $I^-$
(34) V = 5-CN-6-Cl, R = $C_3H_7$, M = $I^-$
(35) V = 5, 6-$Cl_2$, R = $(CH_2)_3SO_3^-$, M = no ion
(36) V = 5, 6-$(CH_3)_2$, R = $CH_2CO_2^-$, M = no ion
(37) V = 5-$OCH_3$, R = $(CH_2)_2OCH_3$, M = $Br^-$
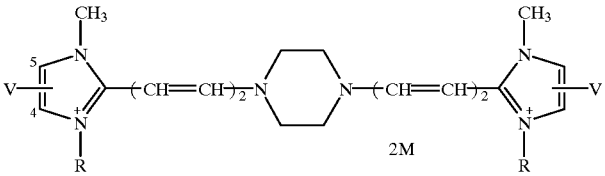
(38) V = 4-$CH_3$, R = $CH_3$, M = $I^-$
(39) V = 4-$OCH_3$, R = $(CH_2)_4SO_3^-$, M = no ion
(40) V = 4,5-$(CH_3)_2$, R = $C_2H_5$, M =$Br^-$
(41) V = 4-Cl, R = $(CH_2)_2CO_2^-$, M = no ion
(42) V = 4-F, R = $(CH_2)_3OSO_3^-$, M = no ion -continued
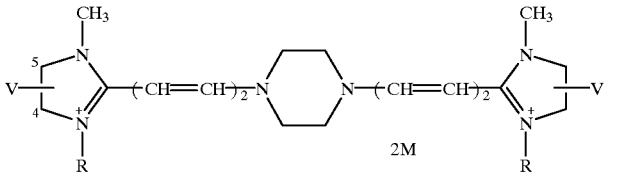
2M
(43) V = 4-$CH_3$, R = $CH_3$, M = $Br^-$
(44) V = 4, 4-$CH_3$, R = $CH_3$, M = $Cl^-$
(45) V = 4-Cl, R = $CH_3$, M = $Br^-$
(46) V = H, R = $(CH_2)_3SO_3^-$, M = no ion
(47)
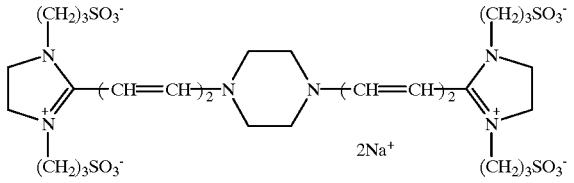
(48)
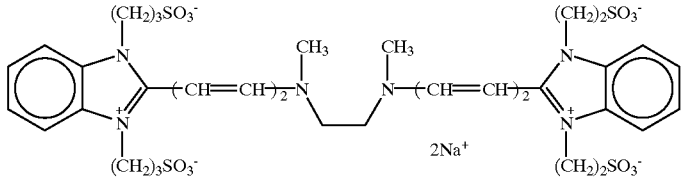
(49)
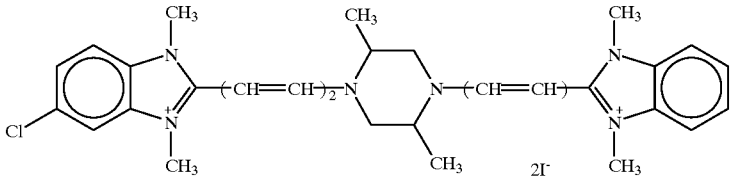
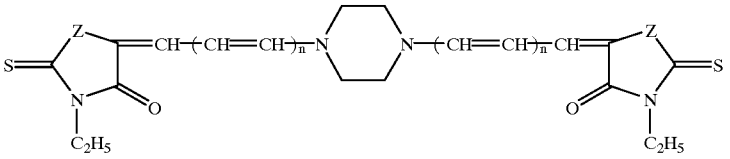
(50); Z = S, n = 1
(51); Z = S, n = 2
(52); Z = O, n = 3
(53); Z = N—$CH_3$, n = 1
(54); Z = N—$CH_3$, n = 0
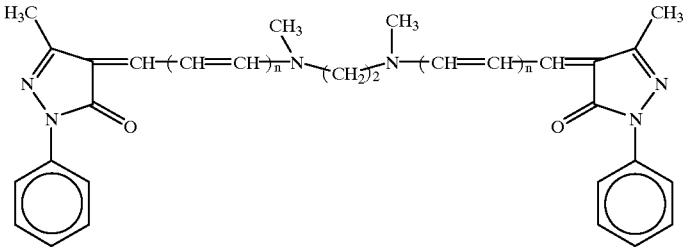
(55); n = 0
(56); n = 1
(57); n = 2

-continued
(58); n = 3
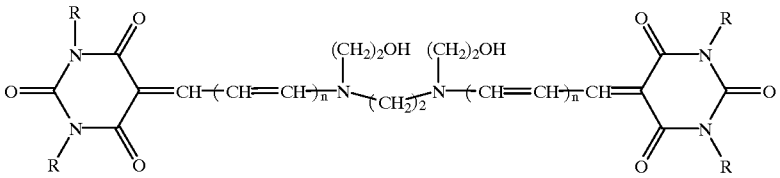
(59); R = $C_2H_5$, n = 0, M = no ion
(60); R = $CH_2CO_5H$, n = 1, M = no ion
(61); R = $(CH_2)_3SO_3^-$, n = 2, M = $4Na^+$
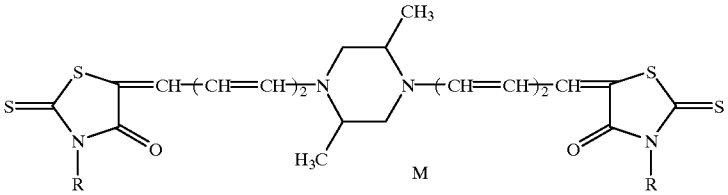
(62); R = $CH_2CONHSO_2CH_3$, M = no ion
(63); R = $CH_2CO_2H$, M = no ion
(64); R = $(CH_2)_3SO_3^-$, M = $2Na^+$
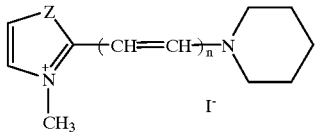
(65) Z = O, n = 2
(65) Z = S, n = 2
(67) Z = S, n = 3
(68) Z = Se, n = 2
(69) Z = $CH(CH_3)_2$, n = 2
(70) Z = N—$CH_3$, n = 2
(71) Z = N—$CH_3$, n = 3
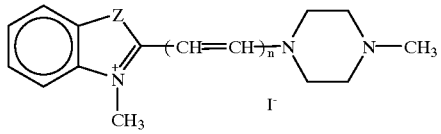
(72) Z = O, n = 2
(73) Z = S, n = 2
(74) Z = S, n = 3
(75) Z = Se, n = 2
(76) Z = N—$CH_3$, n = 2
(77) Z = N—$CH_3$, n = 3
(78) Z = $CH_2$, n = 2
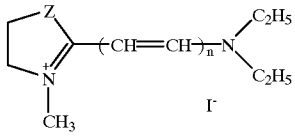
(79) Z = O, n = 2
(80) Z = S, n = 2

-continued
(81) Z = S, n = 3
(82) Z = Se, n = 2
(83) Z = N—$CH_3$, n = 2
(84) Z = N—$CH_3$, n = 3
(85) Z = $CH_2$, n = 2
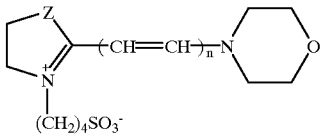
(86) Z = O, n = 2
(87) Z = S, n = 2
(88) Z = S, n = 3
(89) Z = N—$CH_3$, n = 2
(90) Z = N—$CH_3$, n = 3
(91) Z = Se, n = 2
(92)
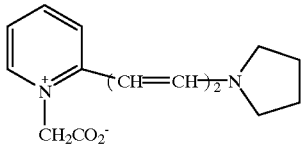
(93)
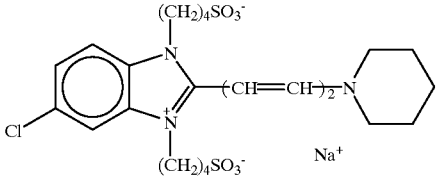
(94)
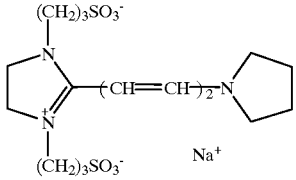
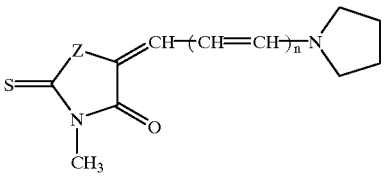
(95) Z = O, n = 1
(96) Z = S, n = 1
(97) Z = S, n = 2
(98) Z =Se, n = 1
(99) Z = N—$CH_3$, n = 1
(100) Z = N—$CH_3$, n = 2

-continued

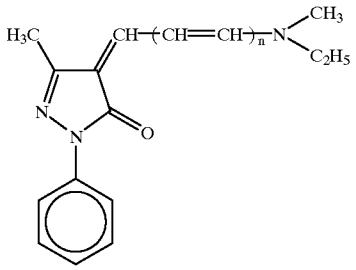

(101) n = 1

(102) n = 0

(103) n = 2

(104) n = 3

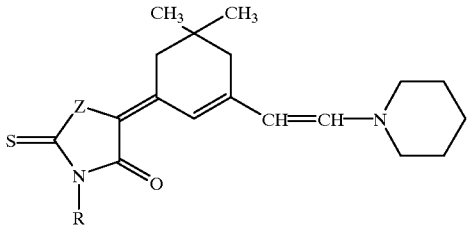

(105) Z = S, R = $CH_2CO_2H$ (106) Z = N—$CH_3$, R = $(CH_2)_2SO_3^-$ (107) Z = Se, R = $CH_2$—

(108) Z = O, R = —

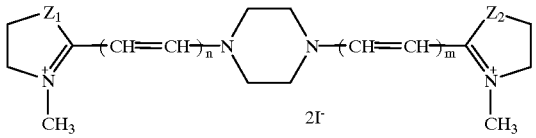

(109); $Z_1$ = S, n = 2, $Z_2$ = O, m = 2

(110); $Z_1$ = S, n = 2, $Z_2$ = N—$CH_3$, m = 2

(111); $Z_1$ = S, n = 2, $Z_2$ = S, m = S (112); $Z_1$ = S, n = 2, $Z_2$ = $CH_2$, m = 2

(113); $Z_1$ = O, n = 1, $Z_2$ = S, m = 2

The compounds represented by formulae (I), (II), (III) and (IV) according to the present invention can be synthesized according to the methods described, e.g., in F. M. Harmer, *Heterocyclic Compounds—Cyanine Dyes and Related Compounds*—, John Weley & Sons, New York•London (1964); D. M. Starmer, *Heterocyclic Compounds—Special Topics in Heterocyclic Chemistry*, John Weley & Sons, New York•London (1977); and *Rodd's Chemistry of Carbon Compounds,* 2nd Ed., vol. IV, part B, chap. 15, pp. 369–422, Elsevier Science Publishing Company Inc., New York (1977).

SYNTHESIS EXAMPLE

Synthesis of Exemplified Compound (7)

The intended compound is synthesized in accordance with the following reaction scheme;

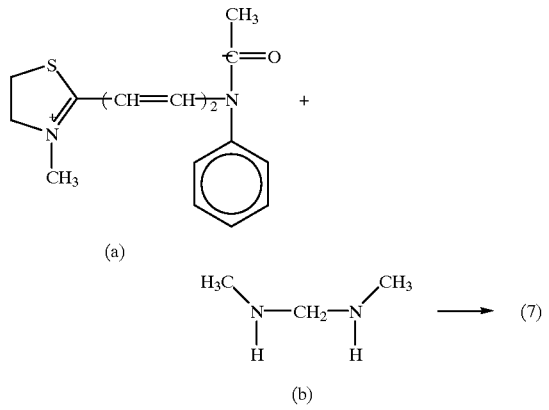

Specifically, 0.21 g (0.00241 mole) of Compound (b) was added to 2 g (0.00483 mole) of Compound (a) and 30 ml of ethanol, and heated on a steam bath under reflux for 1 hour. The reaction mixture obtained was cooled to deposit a crystal-line precipitate. The precipitate was filtered off with suction, and the powder thus obtained was dissolved in a mixture of 100 ml of methanol with 100 ml of chloroform by heating under reflux and then subjected to natural filtration. The filtrate obtained was evaporated under atmospheric pressure to remove 100 ml of the solvent. The residue liberated a crystalline precipitate on standing. The precipitate was filtered off with suction, and dried. Thus, 0.95 g of Compound (7) was obtained as a yellow powder in a 61% yield. $\lambda_{max}$=449 nm, $\epsilon$=114000 (in methanol), mp.: decomposed at a temperature higher than 280° C.

In the next place, silver halide photographic materials according to the present invention are illustrated below in detail.

In silver halide photographic materials, the compounds represented by formulae (I), (II), (III) and (IV) according to the present invention (hereinafter referred to as the present methine compounds) can be incorporated individually or in combination with other sensitizing dyes.

The time for the present methine compounds (and other sensitizing dyes, too) to be added to the silver halide emulsions for use in the present invention may be in any stages of emulsion-making process as far as they have hitherto been admitted to be useful for addition of spectral sensitizing dyes. For instance, the present methine compounds can be added in the stage of forming silver halide grains or/and in a period before desalting, or in the desalting stage and/or the period after desalting and before the beginning of chemical ripening, as disclosed in U.S. Pat. Nos. 2,735,766, 3,628,960, 4,183,756 and 4,225,666, JP-A-58-184142 and JP-A-60-196749; or they can be added just before or in the stage of chemical ripening, or in any stage or step during the period from the completion of chemical ripening to the emulsion coating, as disclosed in JP-A-58-113920. In addition, as disclosed in U.S. Pat. No. 4,225,666 and JP-A-58-7629, the same compound alone or in combination with a compound having a different structure may be added in separate periods, for example, in the grain formation stage and the chemical ripening stage or the period after the completion of chemical ripening, or before or in the stage of chemical ripening and in the period after the completion of chemical ripening. Further, in such separate additions, different compounds or different combinations with compounds may be used respectively. Furthermore, in the case of grain formation using a crystal habit control agent, the present methine compounds adsorb to silver halide grains in competition with the crystal habit control agent; as a result, the crystal habit control agent is desorbed from the grain surface. Desirably, the desorbed crystal habit control agent is removed from the emulsions. For the removal thereof, a washing operation is effective. Thus, it is desirable that the present methine compounds be added before the washing step.

Appropriate amounts of the present methine compounds added to silver halide emulsions, though depend on the shape and size of silver halide grains, are within the range of $1\times10^{-6}$ to $8\times10^{-3}$ mole per mole of silver halide. When the grain size of silver halide is from 0.2 to 1.3 $\mu$m, for instance, it is desirable to add the compounds for use in the present invention in an amount of from $2\times10^{-6}$ to $3.5\times10^{-3}$ mole, preferably from $7.5\times10^{-6}$ to $1.5\times10^{-3}$ mole, per mole of silver halide.

The present methine compounds can be dispersed directly into silver halide emulsions. Also, they are first dissolved in appropriate solvents, such as methanol, ethanol, methyl cellosolve, acetone, water, pyridine or a mixture of two or more thereof, and then added to the emulsions. Herein, additives, such as a base, an acid and a surfactant, can be present. For the dissolution, supersonic waves may be used. On the other hand, the present methine compounds can be incorporated into emulsions using various methods, e.g., the method as described in U.S. Pat. No. 3,469,987 wherein a dye is dissolved in a volatile organic solvent, dispersed into a hydrophilic colloid, and then added to an emulsion; the method as described in JP-B-46-24185 wherein a water-insoluble dye is dispersed into a water-soluble solvent, and then added to an emulsion; the method as described in U.S. Pat. No. 3,822,135 wherein a methine compound is dissolved in a surfactant and then added to an emulsion; the method as described in JP-A-51-74624 wherein a dye is dissolved with a red shift compound and then added to an emulsion; and the method as described in JP-A-50-80826 wherein a methine compound is dissolved in a substantially water-free acid, and then added to an emulsion. In addition to those methods, the methods described in U.S. Pat. Nos. 2,912,343, 3,342,605, 2,996,287 and 3,429,835 can be used for the addition of the present methine compounds to emulsions.

The present methine compounds can also be used as filter dyes, irradiation inhibiting dyes, antihalation dyes and the like for the purpose of achieving improvements in sharpness and color separability.

The methine compounds used as such dyes can be incorporated in coating solutions for forming constituent layers of a silver halide photographic material, a filter layer and/or an antihalation layer, in a conventional manner. The amounts incorporated may be sufficient amounts for coloring the desired photographic layers, which can be easily determined by persons skilled in the art depending on the purposes in using those dyes. In general, it is desirable for the dyes to be used in such an amount as to provide an optical density of from 0.05 to 3.0.

The time of incorporation may be at any stage before the coating are applied.

Further, polymers having electric charges opposite to dye ions may be present as mordants in the layers containing the aforementioned dyes. Through the interaction with such polymers, the dyes can be localized in particular layers.

Examples of such a polymer mordant include those described in U.S. Pat. Nos. 2,548,564, 4,124,386, 3,625,694, 3,958,995, 4,168,976 and 3,445,231.

Examples of a supersensitizer useful for the spectral sensitization in the present invention include the pyrimidylamino compounds, the triazinylamino compounds and the azolium compounds described, e.g., in U.S. Pat. Nos. 3,511,664, 3,615,613, 3,615,632, 3,615,641, 4,596,767, 4,945,038, and 4,965,182, and suitable methods for supersensitization include the methods described in those patents.

Silver halide photographic materials according to the aforementioned embodiments (1) to (4) of the present invention are illustrated below in detail.

The silver halide usable in the silver halide photographic materials of the present invention may be any of silver bromide, silver iodobromide, silver iodochlorobromide, silver chlorobromide and silver chloride. Preferably, silver bromide, silver chlorobromide, silver iodochlorobromide or the silver halide having a high silver chloride content as described in JP-A-2-42 is used in the photographic materials of the present invention.

The constitution and the processing method of a photographic material according to the present invention are described below. In particular, the constitution and the processing method described in JP-A-2-42 are preferably adopted in the case of silver halide having a high silver chloride content.

On the other hand, the constitution and the processing method described in JP-A-63-264743 are preferably used in the case of silver chlorobromide.

The interior and the surface of the silver halide grains may differ, or the silver halide grains may be uniform throughout. Further, the silver halide grains used in the photographic materials of the present invention may be silver halide grains of the kind which form a latent image predominantly at the surface of the grains (e.g., negative photographic materials), or grains of the kind which mainly form a latent image inside the grains (e.g., internal latent image type photographic materials), or prefogged grains (e.g., direct positive photographic materials).

The photographic materials (elements) can use various kinds of silver halide grains, which have various halide compositions as described above and differ from one another in crystal habit, inside structure, shape and distribution, depending on the end-use purpose thereof.

The silver halide grains in the photographic materials of the present invention are grains having tabular crystal shapes. The aspect ratio (circle-equivalent diameter/thickness ratio) of these tabular grains is at least 3, desirably from 3 to 100. The expression "the aspect ratio is from 3 to 100" as used herein means that the proportion of the silver halide grains having their aspect ratios in the range of 3 to 100 to the total silver halide grains in an emulsion is at least 50%, preferably at least 70, particularly preferably at least 85%, on a projected area basis. The expression "circle-equivalent diameter" as used herein means the diameter of a circle having the same area as the projected area of a grain. The expression "sphere-equivalent diameter" as used herein means the diameter of a sphere having the same volume as that of a grain.

The aspect ratio is preferably from 3 to 50, more preferably from 5 to 50, and particularly preferably from 8 to 30.

The tabular grains can be prepared using the methods described in Gutoff, *Photographic Science and Engineering*, vol. 14, pp. 248–257 (1970); U.S. Pat. Nos. 4,434,226, 4,414,310, 4,433,048 and 4,439,520; GB Patent 2,112,157; and WO 96/30808, p. 16, line 5, to p.20, line 19.

The present methine compounds are used as sensitizers, or sensitizing dyes, or for various purposes, such as filter, antihalation and prevention of irradiation, in photographic materials with the following uses. Besides light-sensitive emulsion layers, other constituent layers, such as an interlayer, a protective layer and a backing layer, can contain those dyes, if desired.

The present methine compounds can be used in various kinds of color and black-and-white silver halide photographic materials.

More specifically, they can be used in a color positive photographic material, a photographic material for color paper, a color negative photographic material, a color reversal photographic material (in which couplers may be incorporated or not), a direct positive silver halide photographic material, a photographic material for photomechanical process (e.g., lith film, lithographic dupe film), a photographic material for CRT display, a photographic material for X-ray recording (especially for direct radiography or fluorography using a screen), a photographic material used for a silver salt diffusion transfer process, a photographic material used for a color diffusion transfer process, a photographic material used for a dye transfer process (including an imbibition process), a photographic material for a silver dye bleach process, a heat developable photographic material, and so on.

The silver halide photographic emulsions used in the present invention can be prepared using the methods described, e.g., in P. Glafkides, *Chimie et Phisigue Photographique*, Paul Montel (1967), G. F. Duffin, *Photographic Emulsion Chemistry*, The Focal Press (1966), and V. L. Zelikman et al., *Making and Coating Photographic Emulsion*, The Focal Press (1964).

In forming the silver halide emulsion grains, silver halide solvents such as ammonia, potassium thiocyanate, ammonium thiocyanate, a thioether compound (as described, e.g., in U.S. Pat. No. 3,271,157, 3,574,628, 3,704,130, 4,297,439 or 4,276,374), a thione compound (as described, e.g., in JP-A-53- 144319, JP-A-53-82408 or JP-A-55-77737) and an amine compound (as described, e.g., in JP-A-54-100717) can be used for the purpose of controlling growth of the grains.

In a process of producing silver halide grains or allowing the produced silver halide grains to ripen physically, a cadmium salt, a zinc salt, a thallium salt, an iridium salt or complex, a rhodium salt or complex, an iron salt or complex, and the like may be present.

Examples of an internal latent image type silver halide emulsion which can be used in the present invention include conversion type silver halide emulsions, core/shell type silver halide emulsions and foreign metal-incorporated silver halide emulsions as described, e.g., in U.S. Pat. Nos. 2,592,250, 3,206,313, 3,447,927, 3,761,276 and 3,935,014.

Usually, the silver halide emulsions are chemically sensitized. Chemical sensitization can be carried out using methods described, e.g., in H. Frieser, *Die Gründlagen der Photographischen Prozesse mit Silverhalogeniden*, pp. 675–734, Akademische Verkagsgesellschaft (1968).

More specifically, sulfur sensitization using active gelatin or compounds containing sulfur capable of reacting with silver ion (e.g., thiosulfates, thioureas, mercapto compounds, rhodanines), selenium sensitization, reduction sensitization using reducing materials (e.g., stannous salts, amines, hydrazine derivatives, formamidine sulfinic acid, silane compounds), precious metal sensitization using precious metal compounds (e.g., gold metal complexes and Group VIII metal complexes, such as those of platinum, iridium and palladium) and so on can be employed individually or as a combination thereof.

The photographic materials of the present invention can contain a wide variety of compounds for the purpose of protecting them against fogging and stabilizing photographic properties during production, storage or photographic processing. Examples of compounds which can be added to the photographic materials of the present invention for the foregoing purpose include azoles, such as thiazoles, for example, the benzothiazolium salts described, e.g., in U.S. Pat. Nos. 3,954,478 and 4,942,721 and JP-B-59-191032, and the ring-opened benzothiazolium salts described in JP-B-59-26731, nitroindazoles, triazoles, benzotriazoles, and benzimidazoles (especially, nitro- or halogen-substituted ones); heterocyclic mercapto compounds, such as mercaptothiazoles, mercaptobenzothiazoles, mercaptobenzimidazoles, mercaptothiadiazoles, mercaptotetrazoles (especially, 1-phenyl-5-mercaptotetrazole) and mercaptopyrimidines; the above-described heterocyclic mercapto compounds containing water-soluble groups, such as carboxyl or sulfo groups; thioketo compounds, such as oxazolinethione; azaindenes, such as tetraazaindenes (especially, (1,3,3a,7) tetrazaindens substituted with a hydroxy group at the 4-position); benzenethiosulfonic acids; benzenesulfinic acids; the acetylene compounds described in JP-A-62-87957; and other many compounds known as an antifoggant or a stabilizer.

The silver halide photographic materials of the present invention can contain color couplers, such as a cyan coupler, a magenta coupler and a yellow coupler, and compounds in which those couplers are dispersed.

More specifically, the silver halide photographic materials of the present invention may contain compounds capable of forming colors by oxidative coupling with aromatic primary amine developing agents (e.g., phenylenediamine derivatives, aminophenol derivatives) upon color development processing. Examples of a magenta coupler which can be used in the present invention include 5-pyrazolone couplers, pyrazolobenzimidazole couplers, cyanoacetylcumarone couplers and open-chain acylacetonitrile couplers; examples of a yellow coupler usable herein include acylacetamide couplers (e.g., benzoylacetanilides, pivaloylacetanilides); and examples of a cyan coupler usable herein include naphthol couplers and phenol couplers. It is desirable for the color couplers to be nondiffusible couplers having hydrophobic groups called ballast groups. These couplers each may be equivalent to either two or four silver ions. Also, colored couplers having color compensating effects or couplers capable of releasing development inhibitors upon development (the so-called DIR couplers) may be used.

Besides DIR couplers, non-color-forming DIR coupling compounds capable of producing colorless compounds and releasing development inhibitors upon coupling reaction may be employed.

For the purpose of increasing the sensitivity and contrast, or accelerating the developing rate, the photographic materials of the present invention may contain, e.g., polyalkylene oxides and derivatives thereof, such as the ethers, esters and amines thereof, thioether compounds, thiomorpholines, quaternary ammonium salt compounds, urethane derivatives, urea derivatives, imidazole derivatives and 3-pyrazolidones.

In silver halide photographic materials according to the present invention, other dyes besides the present methine compounds can be used as filter dyes or other various purposes, including the prevention of irradiation. Suitable examples of such dyes include the oxonol dyes having pyrazolone or barbituric acid nuclei as described, e.g., in GB Patents 506,385, 1,177,429, 1,311,884, 1,338,799, 1,385,371, 1,467,214, 1,433,102 and 1,553,516, JP-A-48-85130, JP-A-49-114420, JP-A-52-117123, JP-A-55-161233, JP-A-59-111640, JP-B-39-22069, JP-B-43-13168, JP-B-62-273527, and U.S. Pat. Nos. 3,247,127, 3,469,985 and 4,078,933; the other oxonol dyes described, e.g., in U.S. Pat. Nos. 2,533,472 and 3,379,533, GB Patent 1,278,621, JP-A-1-134447, and JP-A-1-183652; the azo dyes described, e.g., in GB Patents 575,691, 680,631, 599,623, 786,907, 907,125 and 1,045,609, U.S. Pat. No. 4,255,326, and JP-B-59-211043; the azomethine dyes described, e.g., in JP-A-50-100116, JP-A-54-118247, and GB Patents 2,014,598 and 750,031; the anthraquinone dyes described in U.S. Pat. No. 2,865,752; the arylidene dyes described, e.g., in U.S. Pat. Nos. 2,533,009, 2,688,541 and 2,538,008, GB Pat. Nos. 584,609 and 1,210,252, JP-A-50-40625, JP-A-51-3623, JP-A-51-10927, JP-A-54-118247, JP-B-48-3286, and JP-B-59-37303; the styryl dyes described, e.g., in JP-B-28-3082, JP-B-44-16594, and JP-B-59-28898; the triarylmethane dyes described, e.g., in GB Pat. Nos. 446,583 and 1,335,422, and JP-A-59-228250; the merocyanine dyes described, e.g., in GB Patents 1,075,653, 1,153,341, 1,284,730, 1,475,228 and 1,542,807; and the cyanine dyes described, e.g., in U.S. Pat. Nos. 2,843,486 and 3,294,539, and JP-A-1-291247.

In order to prevent those dyes from diffusing, the following methods can be adopted.

For instance, the method of allowing a hydrophilic polymer having the electric charge opposite to an associated anionic dye to be present as a mordant in the layer containing the anionic dye to achieve the localization of the dye in the particular layer through the interaction between them is disclosed, e.g., in U.S. Pat. Nos. 2,548,564, 4,124,386 and 3,625,694.

Further, the method of dyeing a particular layer by the use of a water-insoluble dye solid is disclosed, e.g., in JP-A-56-12639, JP-A-55-155350, JP-A-55-155351, JP-A-63-27838, JP-A-63-197943, and European Pat. No. 15,601.

Furthermore, the method of dyeing a particular layer by the use of fine particles of a metal salt to which a dye is adsorbed is disclosed, e.g., in U.S. Pat. Nos. 2,719,088, 2,496,841 and 2,496,843, and JP-A-60-45237.

The photographic materials of the present invention may contain various surfactants for a wide variety of purposes, such as coating aids, prevention of electrification, improvement of slipping properties, emulsion dispersion, prevention of adhesion and improvements of photographic characteristics (e.g., development acceleration, hard tone enhancement, sensitization).

In embodying the present invention, other additives can be used together with silver halide emulsions or other hydrophilic colloids. Examples of such additives include discoloration inhibitors, inorganic or organic hardeners, color fog inhibitors, ultraviolet absorbents, mordants, plasticizers, latex polymers and matting agents. These agents are described specifically, e.g., in *Research Disclosure*, Vol. 176 (1978,XI), D-17643.

Also, hydrophilic polymers, such as gelatin, are used as protective colloids in the photographic materials of the present invention.

The finished silver halide emulsions and so on are coated on an appropriate support, such as baryta paper, resin-coated paper, synthetic paper, a triacetate film, a polyethylene terephthalate film, another plastic base, or a glass plate.

The exposure for obtaining a photographic image may be carried out in a conventional manner. For the exposure can be employed any various known light sources, such as natural light (sun light), a tungsten lamp, a fluorescent lamp, a mercury lamp, a xenon arc lamp, a xenon flash lamp. and cathode-ray tube flying spot. Suitable exposure times which can be used include not only exposure times commonly used in cameras ranging from 1/1000 to 1 second but also exposure times shorter than 1/1000 second, for example, $1/10^4$ to $1/10^6$ second as used with a xenon flash lamp and a cathode-ray tube. Exposure times longer than 1 second can also be used. The spectral distribution of the light used for the exposure can be controlled with a color filter, if needed. Also, laser beams can be used for the exposure. In addition, the exposure may be carried out with light emitted from a phosphor-excited by electron beams, X rays, γ rays, α rays or the like.

The photographic processing of photographic materials prepared in accordance with the present invention can be performed using any known methods and any known processing solutions as described, e.g., in *Research Disclosure*, Vol. 176, pp. 28–30, RD-17643, (December, 1978). Either photographic processing for forming a silver image (black-and-white photographic processing) or photographic processing for forming dye images (color photographic processing) may be applied to the photographic materials of the present invention in answer to their purposes. The processing temperature is generally chosen from the range of 18° C. to 50° C., but it may be lower than 18° C. or higher than 50° C.

The photographic materials of the present invention may be silver halide photographic materials bearing magnetic records (hereinafter referred to as "photosensitive materials"). Such a photosensitive material can be prepared as follows:

A thin-layer support of previously heat-treated (annealed) polyester as described in detail in JP-A-6-35118, JP-A-6-17528 and *JIII Journal of Technical Disclosure*, No. 94-6023, for example, a polyethylene aromatic dicarboxylate type polyester support having a thickness of from 50 to 300 μm, preferably from 50 to 200 μm, more preferably from 80 to 115 μm, particularly preferably from 85 to 105 μm, and previously annealed for 1 to 1500 hours at a temperature ranging from 40° C. to its glass transition temperature, is subjected to a surface treatment, such as the ultraviolet irradiation described in JP-B-43-2603, JP-B-43-2604 or JP-B-45-3828, or the corona discharge described, e.g., in JP-B-48-5043 or JP-A-51-131576, and then provided with the undercoat described in U.S. Pat. No. 5,326,689, and, if desired, coated with the subbing layer described in U.S. Pat. No. 2,761,791, and further coated with the ferromagnetic particles described in JP-A-59-23505, JP-A-4-195726 or JP-A-6-59357.

Additionally, the magnetic layer described above may be replaced by the coating formed in stripes as described in JP-A-4-124642 or JP-A-4-124645.

Further, the foregoing support undergoes the antistatic treatment described in JP-A-4-62543, if needed, and finally coated with a silver halide emulsion. Examples of a silver halide emulsion usable herein include those described in JP-A-4-166932, JP-A-3-41436 and JP-A-3-41437.

It is desirable that the photosensitive material as mentioned above be produced in accordance with the production control method described in JP-B-4-86817 and the production data be recorded therein using the method described in JP-B-6-87146. Before or after the recording, the photosensitive material is cut into films having a width narrower than that of 135 size in the manner described in JP-A-4-125560, and pierced with two holes per small format frame on one side so as to match with the frame having a smaller format than usual.

The thus produced films are used in such form as inserted into the cartridge package described in JP-A-4-157459, the cartridge shown in FIG. 9 as an example of JP-A-5-210202, the film patrone described in U.S. Pat. No. 4,221,479, or the cartridges described in U.S. Pat. No. 4,834,306, U.S. Pat. No. 4,834,366, U.S. Pat. No. 5,226,613 and U.S. Pat. No. 4,846,418.

Preferably, the film cartridge or film patrone of tongue kept-in type as described in U.S. Pat. Nos. 4,848,693 and 5,317,355 can be used from the standpoint of light imperviousness.

Further, the cartridge having a lock mechanism as described in U.S. Pat. No. 5,296,886, the cartridge fitted with a use condition indicator as described in U.S. Pat. No. 5,347,334 and the cartridge having a double exposure prevention mechanism can be used to advantage.

Furthermore, the cartridge which enables a film to be loaded with ease only by inserting thereinto as described in JP-A-6-85128 may be employed.

The thus prepared film cartridges can be used in various ways pertinent to photographing, processing, and users tastes. Herein, a wide variety of cameras, developing machines and laboratory equipment as described below can be employed.

For instance, the foregoing film cartridges (patrones) can fully achieve their functions when loaded on the cameras of easy film load type as described in JP-A-6-8886 and JP-A-6-99908, the automatic winding type cameras as described in JP-A-6-57398 and JP-A-6-101135, the camera described in JP-A-6-205690 which enables the exchange of films in the middle of photographing, the cameras described in JP-A-5-293138 and JP-A-5-283382 which enable the information on the photographing, e.g., as to which photographing technique is adopted, panorama, high vision or usual photographing, to be magnetically recorded on the film (wherein the print aspect ratio can be selected), the camera described in JP-A-6-101194 which has a double exposure prevention mechanism, and the camera described in JP-A-5-150577 which has a mechanism for indicating the use conditions of the film and so on.

The thus exposed films may be processed with automatic processors described in JP-A-6-222514 and JP-A-6-222545. Before, during or after the processing, the methods of utilizing magnetic records on the films as described in JP-A-6-95265 and JP-A-4-123054 may be applied to the exposed films, or the aspect ratio selecting function described in JP-A-5-19364 may be used.

In the case of development processing for motion picture film, the exposed films are spliced using the method described in JP-A-5-119461, and then processed.

In addition, the attach and detach treatment described in JP-A-6-148805 are carried out upon or after the development-processing.

After the foregoing processing, the film information may be transformed into print- via back printing and front printing on color paper in accordance with the method described in JP-A-2-184835, JP-A-4-186335 or JP-A-6-79968.

Further, the index print as described in JP-A-5-11353 or JP-A-5-232594 may be handed to a customer together with the return of the cartridge.

In another color photographic material to which the present invention can be applied to advantage, there are arranged on a support at least one blue-sensitive silver halide emulsion layer in which a yellow color forming coupler is incorporated, at least one green-sensitive silver halide emulsion layer in which a magenta color forming coupler is incorporated, at least one red-sensitive silver halide emulsion layer in which a cyan color forming coupler is incorporated and at least one silver halide emulsion layer capable of producing an interimage effect upon the red-sensitive silver halide emulsion layer all over, and a compound represented by formula (I), preferably formula (III), is incorporated in the aforesaid silver halide emulsion layer which can produce the interimage effect.

Details of color photographic materials of such a type are described in JP-A-7-159950 (corresponding to U.S. Pat. No. 5,538,838).

Next, silver halide photographic materials according to the foregoing embodiments (5) to (8) of the present invention are illustrated in detail.

First, silver halide-gr-ains used in those embodiments are described in detail. The term "high silver chloride content grains" as used herein refers to the silver halide grains having a silver chloride content of at least 50 mole %.

With the intention of forming (111) high silver chloride content grains (or controlling the habit of crystals), various methods have been proposed as mentioned hereinbefore. However, it is preferred in particular to form (111) high silver chloride content grains in the presence of a compound represented by formula (V), (VI) or (VII).

The compounds represented by formulae (V), (VI) and (VII) respectively are illustrated below in detail.

In formula (V), $R_7$ is preferably a straight chain, branched chain or cyclic alkyl group containing 1 to 20 carbon atoms (e.g., methyl, ethyl, isopropyl, t-butyl, n-octyl, n-decyl, n-hexadecyl, cyclopropyl, cyclopentyl, cyclohexyl), an alkenyl group containing 2 to 20 carbon atoms (e.g., allyl, 2-butenyl, 3-pentenyl), or an aralkyl group containing 7 to 20 carbon atoms (e.g., benzyl, phenetyl). Each group represented by $R_7$ may have a substituent. Examples of such a substituent include the groups recited below as examples of groups which are represented by $R_8$ to $R_{12}$ and can be substituted for hydrogen atoms.

$R_8$, $R_9$, $R_{10}$, $R_{11}$ and $R_{12}$ may be the same or different, and each represents a hydrogen atom or a group which can be substituted for a hydrogen atom. Examples of a group which can be substituted for a hydrogen atom include a halogen atom (e.g., fluorine, chlorine, bromine), an alkyl group (e.g., methyl, ethyl, n-propyl, isopropyl, t-butyl, n-octyl, cyclopentyl, cyclohexyl), an alkenyl group (e.g., allyl, 2-butenyl, 3-pentenyl), an alkynyl group (e.g., propargyl, 3-pentynyl), an aralkyl group (e.g., benzyl, phenetyl), an aryl group (e.g., phenyl, naphthyl, 4-methylphenyl), a heterocyclic group (e.g., pyridyl, furyl, imidazolyl, piperidyl, morpholino), an alkoxy group (e.g., methoxy, ethoxy, butoxy), an aryloxy group (e.g., phenoxy, 2-naphthyloxy), an amino group (e.g., unsubstituted amino, dimethylamino, ethylamino, anilino), an acylamino group (e.g., acetylamino, benzoylamino), an ureido group (e.g., unsubstituted ureido, N-methylureido, N-phenylureido), an urethane group (e.g., methoxycarbonylamino, phenoxycarbonylamino), a sulfonylamino group (e.g., methylsulfonylamino, phenylsulfonylamino), a sulfamoyl group (e.g., unsubstituted sulfamoyl, N,N-dimethylsulfamoyl, N-phenylsulfamoyl), a carbamoyl group (e.g., unsubstituted carbamoyl, N,N-diethylcarbamoyl, N-phenylcarbamoyl), a sulfonyl group (e.g., mesyl, tosyl), a sulfinyl group (e.g., methylsulfinyl, phenylsulfinyl), an alkyloxycarbonyl group (e.g., methoxycarbonyl, ethoxycarbonyl), an aryloxycarbonyl group (e.g., phenoxycarbonyl), an acyl group (e.g., acetyl, benzoyl, formyl, pivaroyl), an acyloxy group (e.g., acetoxy, benzoyloxy), a phosphoric acid amide group (e.g., N,N-diethylphosphoric acid amide), an alkylthio group (e.g., methylthio, ethylthio), an arylthio group (e.g., phenylthio), a cyano group, a sulfo group, a carboxyl group, a hydroxyl group, a phosphono group, a nitro group, a sulfino group, an ammonio group (e.g., trimethylammonio), a phosphonio group and a hydrazino group. Each of these groups may be substituted. When it has two or more substituents, the substituents may be the same or different.

By combining $R_8$ with $R_9$, $R_9$ with $R_{10}$, $R_{10}$ with $R_{11}$,, or $R_{11}$ with $R_{12}$, a condensed ring, such as a quinoline, isoquinoline or acridine ring, may be formed.

$X^-$ represents a counter anion, with examples including a halogen ion (e.g., chlorine, bromine), a nitric acid ion, a sulfuric acid ion, a p-toluenesulfonic acid ion and a trifluoromethanesulfonic acid ion.

In formula (V), it is desirable that $R_7$ be an aralkyl group and at least one of the groups $R_8$ to $R_{12}$ be an aryl group.

Preferably, $R_7$, $R_{10}$ and $X^-$ in formula (V) are an aralkyl group, an aryl group and a halogen ion respectively.

Examples of the compound represented by formula (V) according to the present invention are illustrated below, but these examples are not to be considered as limiting on or determinative of the scope of the present invention.

Crystal Habit Control Agent-1

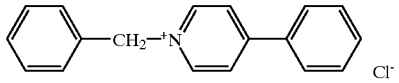

Crystal Habit Control Agent-2

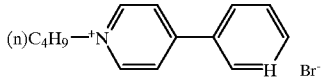

Crystal Habit Control Agent-3

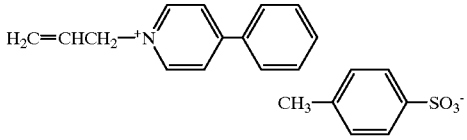

Crystal Habit Control Agent-4

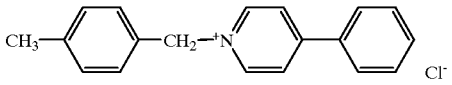

Crystal Habit Control Agent-5

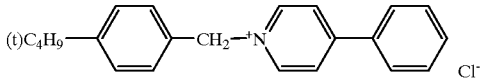

Crystal Habit Control Agent-6

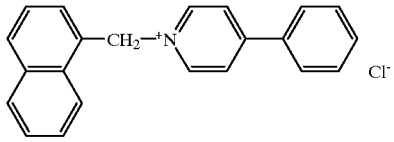

Crystal Habit Control Agent-7

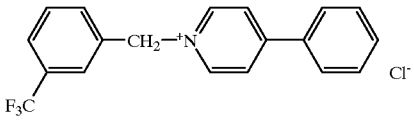

Crystal Habit Control Agent-8

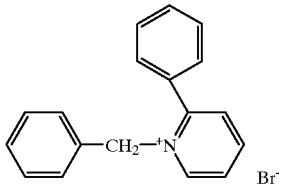

-continued

Crystal Habit Control Agent-9

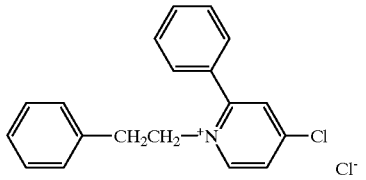

Crystal Habit Control Agent-10

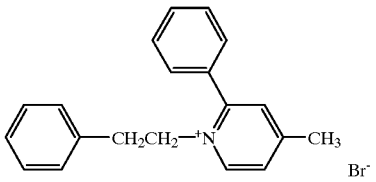

Crystal Habit Control Agent-11

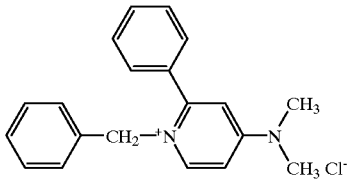

Crystal Habit Control Agent-12

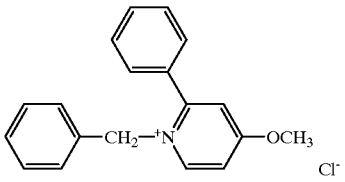

Crystal Habit Control Agent-13

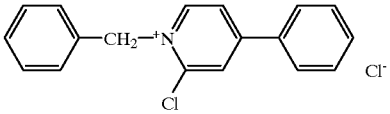

Crystal Habit Control Agent-14

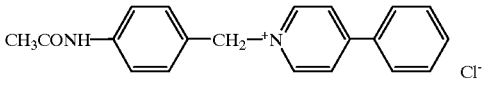

Crystal Habit Control Agent-15

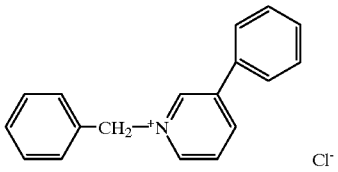

Crystal Habit Control Agent-16

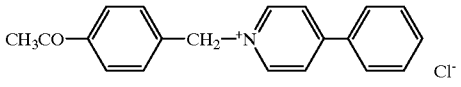

Crystal Habit Control Agent-17

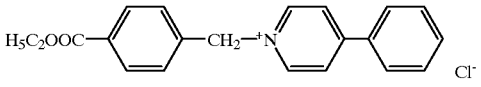

Crystal Habit Control Agent-18

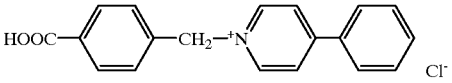

-continued

Crystal Habit Control Agent-19

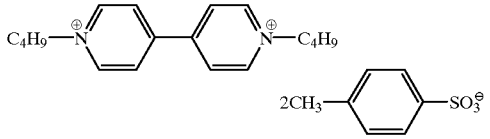

Crystal Habit Control Agent-20

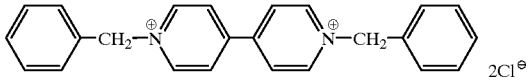

Crystal Habit Control Agent-21

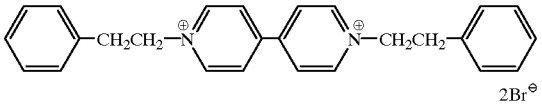

Crystal Habit Control Agent-22

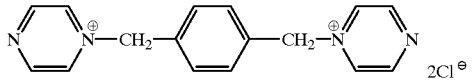

The compounds of formula (V) can be synthesized with ease by reacting commercially available pyridine, quinoline, isoquinoline or acridine compounds with alkylation agents such as alkyl halides.

Compounds represented by formulae (VI) and (VII) respectively which are used in the present invention are described below in detail.

$A_1$, $A_2$, $A_3$ and $A_4$ each represents non-metal atoms completing a nitrogen-containing hetero ring. Such non-metal atoms may include oxygen, nitrogen or/and sulfur atom(s), or fused together with a benzene ring. The hetero rings completed by $A_1$, $A_2$, $A_3$ and $A_4$ respectively may have substituent groups. These substituent groups may be the same or different. Examples of such substituent groups include an alkyl group, an aryl group, an aralkyl group, an alkenyl group, a halogen atom, an acyl group, an alkoxycarbonyl group, an aryloxycarbonyl group, a sulfo group, a carboxyl group, a hydroxyl group, an alkoxy group, an aryloxy group, an amido group, a sulfamoyl group, a carbamoyl group, an ureido group, an amino group, a sulfonyl group, a cyano group, a nitro group, a mercapto group, an alkylthio group and an arylthio group. Suitable examples of a ring completed by $A_1$, $A_2$, $A_3$ and $A_4$ each include 5- to 6-membered rings such as pyridine, imidazole, thiazole, oxazole, pyrazine and pyrimidine rings. Of these rings, a pyridine ring is preferred over the others.

B represents a divalent linking group, with examples including an alkylene group, an arylene group, an alkenylene group, —$SO_2$—, —SO—, —O—, —S—, —CO—, —N(R)—(wherein R represents an alkyl group, an aryl group or a hydrogen atom) and a combination of two or more of the groups recited above. Preferably, B is an alkylene or alkenylene group.

$R_{13}$ and $R_{14}$ each represents an alkyl group containing 1 to 20 carbon atoms. The alkyl groups represented by $R_{13}$ and $R_{14}$ may be the same or different.

The term "alkyl group" as used herein is intended to include substituted and unsubstituted alkyl groups. Examples of a substituent which the alkyl group can have include those recited above as the substituents which $A_1$, $A_2$, $A_3$ and $A_4$ may have.

It is desirable for $R_{13}$ and $R_{14}$ each to be an alkyl group containing 4 to 10 carbon atoms. Preferably, they are each an alkyl group substituted with a substituted or unsubstituted aryl group.

$X^-$ represents an anion, with examples including a chlorine ion, a bromine ion, an iodine ion, a nitric acid ion, a sulfuric acid ion, a p-toluenesulfonate ion and an oxalate ion. n represents 0 or 1, but n is 0 in the case of an inner salt.

Examples of a compound.represented by formula (VI) or ((VII) are illustrated below. Further, other examples thereof include the compounds disclosed in JP-A-2-32 (Exemplified Compounds 1 to 42). However, these examples are not to be considered as limiting on or determinative of the scope of the present invention.

Crystal Habit Control Agent-23

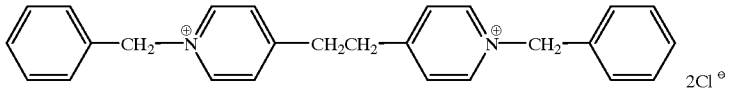

Crystal Habit Control Agent-24

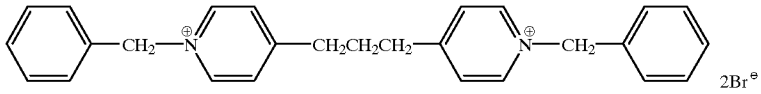

Crystal Habit Control Agent-25

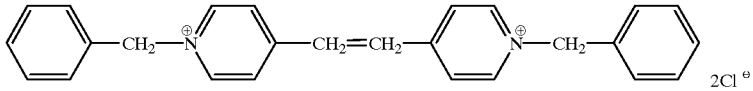

Crystal Habit Control Agent-26

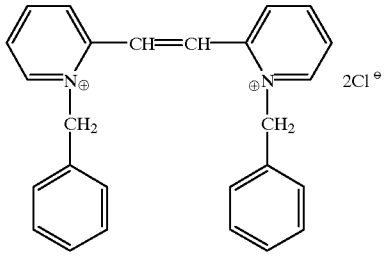

Crystal Habit Control Agent-27

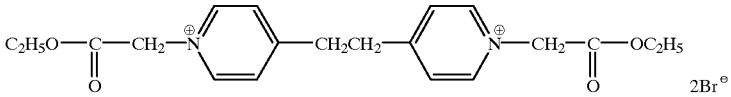

Crystal Habit Control Agent-28

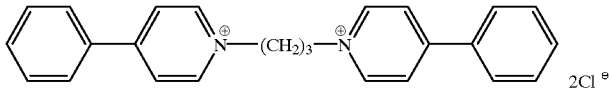

Crystal Habit Control Agent-29

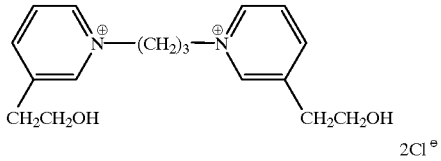

Crystal Habit Control Agent-30

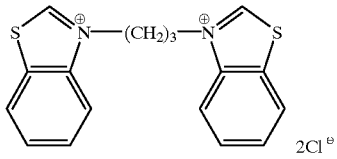

Each of the crystal habit control agents according to the present invention is desirably used in an amount of at least $6\times10^{-5}$ mole, particularly from $3\times10^{-4}$ to $6\times10^{-2}$ mole, per mole of the finished emulsion.

Each crystal habit control agent may be added at any stage of the nucleation, physical ripening or growth process of silver halide grains. The (111) face formation is initiated by the addition of the crystal habit control agent. The crystal habit control agent may be placed in advance in a reaction vessel, or added to a reaction vessel with the progress of the grain growth, if desired, while increasing the concentration.

Examples of grains having (111) surfaces include the grains having a regular crystal shape (such as octahedron or tetradecahedron) and the grains having a tabular shape. Whether the grains formed is the regular grains or the tabular grains depends mainly on the nucleation method adopted, and the addition time and amount of the crystal habit control agent. The nucleation methods which can be adopted are described below.

(1) Formation of Grains having Regular Crystal Shape

It is desirable for t he nucleation to be carried out in the absence of a crystal habit control agent. The chloride concentration during nucleation is controlled to 0.6 mole/l or below, preferably 0.3 mole/l or below, particularly preferably 0.1 mole/l or below.

(2) Formation of G rains having Tabular Crystal Shape

Tabular grains are obtained by forming two parallel twin planes. As the formation of twin planes depends on the temperature, the dispersion medium (gelatin), the halogen concentration and so on, the se conditions should be chosen properly. In a case where a crystal habit control agent is present in the step of nucle a tion, it is desirable that the gelatin concentration be from 0.1 to 10% and the chloride concentration be at least 0.01 mole/l, preferably at least 0.03 mole/l.

In the other case where a crystal habit control agent is not used in the step of nucleation, the gelatin concentration is chosen from the range of 0.03 to 10%, preferably 0.05 to 1.0%, and the chloride concentration is chosen from to the range of 0.001 to 1 mole/l, preferably 0.003 to 0.1 mole/l. The nucleation temperature can be chosen from the range of 2° C. to 90° C. However, it is desirable that the nucleation temperature be from 5° C. to 80° C., preferably from 5° C. to 40° C.

Then, the nuclei formed are physically ripened, and made to grow by the addition of a silver salt and a halide in the presence of a crystal habit control agent. Herein, the chloride concentration is adjusted to a value of no higher than 5 mole/l, preferably from 0.05 to 1 mole/l. The temperature during the grain growth can be chosen from the range of 10° C. to 90° C., but it is desirable to choose the temperature from range of 30° C. to 80° C. When the quantity of a dispersion medium used in the step of nucleation is insufficient for the grain growth, it is necessary to add the dispersion medium for supplement. For the grain growth, it is desirable that gelatin be present in a concentration of from 10 to 60 g/l.

The pH during the grain formation, though may be chosen arbitrarily, is preferably adjusted to neutral or chosen from the acidic range.

The expression "high silver chloride content grains" as used in the present invention refers to the grains having a chloride content of at least 50 mole %. It is preferable for such grains to have a chloride content of at least 80 mole %, particularly at least 95 mole %. The other silver halides present in those grains are silver bromide and/or silver iodide. The silver iodobromide layer can be localized at the grain surface. This localization is desirable for the adsorption of sensitizing dyes. Also, the high silver chloride content grains may be the so-called core/shell grains.

The silver iodide content is from 0.1 to 20 mole %, preferably 0.1 to 5 mole %.

The silver halide grains for use in the present invention have surfaces having (111) faces in a proportion of at least 50%, preferably at least 75%, particularly preferably at least 90%, to the total surface area. The proportion of (111) faces can be determined from the electron photomicrograph of the silver halide grains formed.

When the silver halide grains for use in the present invention are regular crystals, they have no particular limitation as to the average grain size (sphere-equivalent diameter). However, it is desirable for them to have an average grain size of from 0.1 to 5 $\mu$m, particularly from 0.2 to 3 $\mu$m.

When the silver halide grains for use in the present invention are tabular grains, their diameter is preferably from 0.3 to 5.0 $\mu$m, particularly from 0.5 to 3.0 $\mu$m. The term "diameter of a silver halide grain" used herein refers to the diameter of the circle having the same area as the projected area of a grain on the electron photomicrograph. Further, the tabular grains have a thickness of 0.4 $\mu$m or less, preferably 0.3 $\mu$m or less, particularly preferably 0.2 $\mu$m or less. The volume weighted average volume of tabular grains is preferably 2 $\mu m^3$ or less, particularly preferably 1 $\mu m^3$ or less. In addition, the diameter/thickness ratio of tabular grains is preferably at least 2, particularly preferably from 2 to 20.

In general each tabular grain has two parallel surfaces, so that the term "thickness" as used herein is defined as the distance between the two parallel surfaces of each tabular grain.

The size distribution of the silver halide grains for use in the present invention may be polydisperse or monodisperse. However, it is preferable for the grains for use in the present invention to have a monodisperse size distribution.

The presence of a crystal habit control agent on the grain surface after the grain formation has effect on the adsorption of sensitizing dyes and the development. Accordingly, it is desirable that the crystal habit control agent be removed after the grain formation. When the crystal habit control agent is removed, however, it is difficult for the high silver chloride content grains to maintain (111) faces under ordinary condition. Therefore, it is desirable to keep the grain form by replacement with a photographically useful compound such as a sensitizing dye. The methods for such replacement are described, e.g., in JP-A-9-80656, JP-A-9-106026, and U.S. Pat. Nos. 5,221,602, 5,286,452, 5,298,387, 5,298,388 and 5,176,992.

The crystal habit control agent desorbed from the grain surface using the foregoing methods is desirably removed from the emulsion by a washing treatment. The washing treatment is carried out at such a temperature as not to cause the coagulation of gelatin generally used as a protective colloid. For the washing treatment, known various arts, such as flocculation and ultrafiltration, can be adopted. When pyridinium salts are used as crystal habit control agent, the washing treatment is desirably carried out at a temperature of 40° C. or higher, especially 50° C. or higher. In a case where the flocculation method is adopted, it is necessary to use a sedimentation agent. Examples of a sedimentation agent which can be used include those containing sulfonic acid groups and those containing carboxylic acid groups. However, there is strong interaction between a pyridinium salt as crystal habit control agent and a sulfonic acid group, and so a sedimentation agent containing a sulfonic acid group reacts with the pyridinium salt desorbed from grains to form the corresponding salt. This makes it difficult to remove the pyridinium salt by washing. Accordingly, sedimentation agents containing carboxylic acids are preferred. Examples of a sedimentation agent containing a carboxylic acid are disclosed in GB Patent 648,472.

The desorption of a crystal habit control agent from grains is promoted under a low pH condition. Therefore, it is desirable to lower the pH for the washing treatment so far as excess condensation of grains is not caused thereby.

The emulsion grains for use in the present invention may be silver halide grains of the kind which mainly form latent image inside the grains or silver halide grains of the kind which form latent image predominantly at the surface of the grains.

In producing the silver halide emulsion grains for use in the present invention, a silver halide solvent may be used. As a silver halide solvent, thiocyanates (as described, e.g., in U.S. Pat. Nos. 2,222,264, 2,448,534 and 3,320,069), thioether compounds (as described, e.g., in U.S. Pat. Nos. 3,271,157, 3,574,628, 3,704,130, 4,297,439 or 4,276,374), thione compounds and thiourea compounds (as described, e.g., in JP-A-53-144319, JP-A-53-82408 or JP-A-55-77737) and amine compounds (as described, e.g., in JP-A-54-100717) have frequently been used. These silver halide solvents can be used herein, too. In addition, ammonia can be used in such amount as not to affect adversely.

In a process of forming silver halide grains or allowing the formed silver halide grains to ripen physically, cadmium salts, zinc salts, lead salts, thallium salts, iridium salts or complexes, rhodium salts or complexes, iron salts or complexes and/or the like may be present. In particular, the presence of iridium salts or rhodium salts is preferred therein.

In adding a silver salt solution (e.g., an aqueous solution of $AgNO_3$) and a halide solution (e.g., an aqueous solution of NaCl) for the purpose of accelerating the grain growth during the production of the silver halide grains for use in the present invention, it is desirable to adopt methods of increasing the addition speed, the addition amount or/and the addition concentration as the time spent for addition increases.

For details of those methods the descriptions, e.g., in GB Patent 1,335,925, U.S. Pat. Nos. 3,672,900, 3,650,757 and 4,242,445, JP-A-55-142329, JP-A-55-158124, JP-A-58-113927, JP-A-58-113928, JP-A-58-111934 and JP-A-58-111936 can be referred to.

The tabular silver halide grains for use in the present invention, though may be chemically unsensitized grains, can be chemically sensitized, if needed.

For chemical sensitization, the so-called gold sensitization method using gold compounds (as described, e.g., in U.S. Pat. Nos. 2,448,060 and 3,320,069), sensitization methods using such metals as iridium, platinum, rhodium and palladium (as described, e.g., in U.S. Pat. Nos. 2,448,060, 2,566,245 and 2,556,263), sulfur sensitization methods using sulfur-containing compounds (as described, e.g., in U.S. Pat. No. 2,222,264), selenium sensitization methods using selenium compounds, and reduction sensitization methods using tin salts, thiourea dioxide, polyamines and the like (as described, e.g., in U.S. Pat. Nos. 2,487,850, 2,518,698 and 2,521,925) can be employed individually or as a combination of two or more thereof.

In particular, gold sensitization, sulfur sensitization, or the combination thereof is used to advantage in chemically sensitizing the silver halide grains for use in the present invention.

Besides the silver halide grains for use in the present invention as mentioned above, usual silver halide grains can be contained in the emulsion layers of silver halide photographic materials according to the present invention.

In each of the photographic emulsions containing high silver chloride content grains according to the present invention, it is desirable that the proportion of the high silver chloride content grains to the total silver halide grains present therein be least 50%, preferably at least 70%, particularly preferably at least 90%, on the projected area basis.

In a case where a photographic emulsion according to the present invention and other photographic emulsions are used as a mixture, it is desirable to mix them so that high silver chloride content grains according to the present invention be present in a proportion of at least 50% in the mixed emulsion.

Further, it is preferable for the other photographic emulsions mixed with a photographic emulsion according to the present invention to be high silver chloride emulsions having a silver chloride content of at least 50 mole %.

In the spectral sensitization of photographic emulsions according to the present invention, conventional methine dyes and other dyes may be used in combination with the present methine compounds. Suitable spectral sensitizing dyes which may be used include cyanine dyes, merocyanine dyes, complex cyanine dyes, complex merocyanine dyes, holopolar cyanine dyes, hemicyanine dyes, styryl dyes and hemioxonol dyes. Especially useful dyes are cyanine dyes, mercocyanine dyes and complex merocyanine dyes. Any nuclei usually present in cyanine dyes can be the basic heterocyclic nuclei of these dyes. More specifically, basic heterocyclic nuclei include pyrroline, oxazoline, thiazoline, pyrrole, oxazole, thiazole, selenazole, imidazole, tetrazole, pyridine and like nuclei; nuclei formed by fusing together one of the above-recited nuclei and an alicyclic hydrocarbon ring; -and nuclei formed by fusing together one of the above-recited nuclei and an aromatic hydrocarbon ring. Examples of these fused nuclei include indolenine, benzindolenine, indole, benzoxazole, naphtoxazole, benzothiazole, naphthothiazole, benzoselenazole, benzimidazole and quinone nuclei. These nuclei each may have substituents on carbon atoms.

The merocyanine and complex merocyanine dyes can contain 5- or 6-membered heterocyclic nuclei, e.g., pyrazoline-5-one, thiohydantoin, 2-thioxazolidine-2,4-dione, thiazolidine-2,4-dione, rhodanine, thiobarbituric acid and like nuclei, as ketomethylene structure-containing nuclei.

More specifically, the compounds described, e.g., in *Research Disclosure*, Item 17643, page 23, section IV (December, 1978) and the references cited therein can be used.

The time for these dyes to be added to the silver halide emulsions for use in the present invention may be in any stages of emulsion-making process as far as they have hitherto been admitted to be useful for addition of spectral sensitizing dyes. Preferably, those dyes are added subsequently to or simultaneously with the addition of the present methine compounds. Although the sensitizing dyes are generally added during the period from the conclusion of chemical sensitization to the beginning of emulsion-coating, they can be added in the same period as that for chemical sensitizers to effect chemical sensitization and spectral sensitization at the same time, as described in U.S. Pat. Nos. 3,628,969 and 4,225,666, or the spectral sensitization can be initiated by adding them prior to chemical sensitization or before the precipitation of silver halide grains is completed, as described in JP-A-58-113928. In addition, the foregoing dyes may be added in separate stages, for example, one portion thereof is added before chemical sensitization and the other portion is added after the chemical sensitization, as taught by U.S. Pat. No. 4,225,666. Further, the foregoing dyes may be divided into some portions and added separately at any different stages during the grain formation, as taught, e.g., by U.S. Pat. No. 4,183,756.

Those dyes can be added in an amount of from $4\times10^{-6}$ to $8\times10^{-3}$ mole per mole of silver halide. However, the amount added should be controlled so as not to impair spectral sensitizing effect of the present methine compounds.

The silver halide emulsions prepared in accordance with the present invention can be used for both color photographic materials and black-and-white photographic materials.

Color photographic materials for which the silver halide emulsions for use in the present invention are preferably used are color paper, color taking films and color reversal films; while X-ray films, taking films for amateur use and sensitive films for photomechanical process are preferred as black-and-white photographic materials for which the silver halide emulsions for use in the present invention are used. In particular, color paper is favored over the others.

The photographic materials in which the emulsions according to the present invention are employed have no particular limitations as to the other additives. For details of such additives the description in, e.g., *Research Disclosure*, volume 176, item 17643 (December, 1978) (RD 17643) and ibid., volume 187, item 18716 (November, 1979) (RD 18716) can be referred to.

The description places for additives in RD 17643 and RD 18716 are shown below:

| Additives | RD 17643 | RD 18716 |
|---|---|---|
| 1. Chemical sensitizer | p. 23 | p. 648, right column |
| 2. Sensitivity raiser | | " |
| 3. Spectral sensitizer Supersensitizer | pp. 23–24 | p. 648, right column, to p. 649, right column |
| 4. Brightening agent | p. 24 | |
| 5. Antifoggant and Stabilizer | pp. 24–25 | p. 649, right column |
| 6. Light absorbent, Filter dye, and UV absorbent | pp. 25–26 | p. 649, right column, to p. 650, left column |
| 7. Stain inhibitor | p. 25, right column | p. 650, left to right column |
| 8. Dye image stabilizer | p. 25 | |
| 9. Hardener | p. 26 | p. 651, left column |
| 10. Binder | p. 26 | " |
| 11. Plasticizer, Lubricant | p. 27 | p. 650, right column |
| 12. Coating aid, Surfactant | pp. 26–27 | " |
| 13. Antistatic agent | p. 27 | " |

As an antifoggant and a stabilizer which are included in the above-recited additives, azoles [e.g., benzothiazolium salts, nitroindazoles, nitrobenzimidazoles, chlorobnzimidazoles, bromobenzimidazoles, nitroindazoles, benzotriazoles, aminotriazoles]; mercapto compounds [e.g., mercaptothiazoles, mercaptobenzothiazoles, mercaptobenzimidazoles, mercaptothiadiazoles, mercaptotetrazoles (especially 1-phenyl-5-mercaptotetrazole), mercaptopyrimidines, mercaptotriazines]; thioketo compounds such as oxazolinethione; azaindenes [e.g., triazaindenes, tetraazaindenes (especially 4-hydroxysubstituted 1,3,3a,7-tetraazaindenes), pentaazaindenes]; benzenethiosulfonic acid, benzenesulfinic acid and benzenesulfonamide can be used to advantage.

Non-diffusible color couplers having hydrophobic groups called ballast groups or polymeric color couplers are preferably used in the present invention. These couplers each may be equivalent to either two or four silver ions. Also, colored couplers having color compensating effects or couplers capable of releasing development inhibitors upon development (the so-called DIR couplers) may be used. Further, non-color-forming DIR coupling compounds capable of producing colorless compounds and releasing development inhibitors upon coupling reaction may be employed.

Examples of a magenta coupler which can be used in the present invention include 5-pyrazolone couplers, pyrazolobenzimidazole couplers, pyrazolotriazole couplers, pyrazolotetrazole couplers, cyanoacetylcumarone couplers and open-chain acylacetonitrile couplers, yellow couplers which can be used are acylacetamide couplers (e.g., benzoylacetanilides, pivaloylacetanilides), and cyan couplers which can be used are naphthol couplers and phenol couplers. Of those cyan couplers, the phenol couplers wherein an ethyl group is present at the meta-position of the phenol nucleus, the 2,5-diacylamino-substituted phenol couplers, the phenol couplers wherein a phenylureido group is present at the 2-position and an acylamino group is present at the 5-position and the naphthol couplers wherein a sulfonamido, amido or like group is substituted on the 5-position, as described in U.S. Pat. Nos. 3,772,002, 2,772,162, 3,758,308, 4,126,396, 4,334,011, 4,327,173, 3,446,622, 4,333,999, 4,451,559 and 4,427,767, are preferable because of their superiority in image fastness.

In order to satisfy characteristics required for the photographic materials of the present invention, those couplers as recited above can be incorporated in the same layer in combination of two or more thereof, or the same coupler may be incorporated in two or more of separate layers.

Typical representative discoloration inhibitors include hydroquinones, 6-hydroxychromans, 5-hydroxycoumarans, spirochroman, p-alkoxyphenols, hindered phenols with bisphenols as the nucleus thereof, gallic acid derivatives, methylenedioxybenzenes, aminophenols, hindered amines, and the ether or ester derivatives obtained by silylating or alkylating the phenolic hydroxyl groups of the compounds recited above. Also, metal complexes represented by (bissalicylaldoximato)nickel complexes and (bis-N,N-dialkyldithiocarbamato)nickel complexes can be used as discoloration inhibitor.

The photographic processing of the photographic materials of the present invention can be performed using any known methods and any known processing solutions. The processing temperature is generally chosen from the range of 18° C. to 50° C., but it may be lower than 18° C. or higher than 50° C. Either development-processing for forming silver image (black-and-white photographic processing) or color photographic processing which involves the development-processing for forming dye images may be applied to the photographic materials of the present invention in answer to their purposes.

In a black-and-white developer, known developing agents, such as dihydroxybenzenes (e.g., hydroquinone), 3-pyrazolidones (e.g., 1-phenyl-3-pyrazolidone) and aminophenols (e.g., N-methyl-p-aminophenol) can be used alone or in combination of two or more thereof.

In general a color developer is an alkaline aqueous solution containing a color developing agent. As the color developing agent can be used-known aromatic primary amines, such as phenylenediamines (e.g., 4-amino-N,N-diethylaniline, 3-methyl-4-amino-N,N-diethylaniline, 4-amino-N-ethyl-N-β-hydroxyethylaniline, 3-methyl-4-amino-N-ethyl-N-β-hydroxyethylaniline, 3-methyl-4-amino-N-ethyl-N-β-methanesulfoamidoethylaniline, 4-amino-3-methyl-N-ethyl-N-β-methoxyethylaniline).

In addition to these compounds, color developing agents which may be used herein include those described, e.g., in L. F. A. Mason, *Photoaraphic Processing Chemistry*, pages 226–229, Focal Press (1966), U.S. Pat. Nos. 2,193,015 and 2,592,364 and JP-A-48-64933.

Besides the developing agents, each developer can contain pH buffers, such as sulfites, carbonates, borates and phosphates of alkali metals, and development inhibitors or antifoggants, such as bromides, iodides and organic antifoggants. Further, each developer may contain water softeners, preservatives such as hydroxylamine, organic solvents such as benzyl alcohol and diethylene glycol, development accelerators such as polyethylene glycol, quaternary ammonium salts and amines, dye forming couplers, competing couplers, fogging agents such as sodium borohydride, auxiliary developers such as 1-phenyl-3-pyrazolidone, viscosity imparting agents, the polycarboxylic acid type chelating agents described in U.S. Pat. No. 4,083,723 and antioxidants described in West German Patent Publication (OLS) No. 2,622,950, if needed.

In the case of color photographic processing, the photographic materials are generally bleached after color development. The bleach processing may be carried out simultaneously with fixing or separately therefrom. Examples of a bleaching agent which can be used therein include polyvalent metal compounds such as iron(III), cobalt(III), chromium(IV) or copper(II) compounds, peracids, quinones, and nitroso compounds. Specifically, ferricyanides, bichromates, and iron(III) or cobalt(II) complexes of organic acids, such as aminopolycarboxylic acids (e.g., ethylenediaminetetraacetic acid, nitrilotriacetic acid, 1,3-diamino-2-propanoltetraacetic acid), citric acid, tartaric acid and malic acid; persulfates and permanganates; and nitrosophenols. Of these compounds, potassium ferricyanide, sodium ethylenediaminetetraacetato ferrate, ammonium ethylenediaminetetraacetato farrate are particularly useful. Ethylenediaminetetraacetic acid-iron(III) complexes are useful in both an independent bleaching bath and a combined bleaching and fixing bath.

The bleaching or bleach-fix bath also can contain various additives, such as the bleach accelerators described, e.g., in U.S. Pat. Nos. 3,042,520 and 3,241,966, JP-B-45-8506 and JP-B-45-8836, and the thiol compounds described in JP-A-53-65732. After the bleach or bleach-fix processing, the photographic materials may be washed with water or processed with a stabilizing bath alone.

The photographic materials of the present invention can be utilized as the heat developable photosensitive material as described in JP-A-6-138619.

In constituting a photosensitive material in which an original scene can be recorded and reproduced as the corresponding color images, the color reproduction using a subtractive color process is basically employed. More specifically, the color information of an original scene can be recorded by forming a photosensitive material provided with at least three kinds of light-sensitive layers having their sensitivities in blue, green and red wavelength regions respectively, and incorporating in these layers respectively color couplers capable of forming yellow, magenta and cyan dyes, the colors of which are complementary to the colors of the wavelength regions in which the foregoing layers have their individual sensitivities. And a photographic color paper, which has the same complementary relationship as the foregoing photosensitive material between the light-sensitive wavelength and the hues of developed colors, is exposed to light via the dye images formed in the foregoing photosensitive material, thereby reproducing the original scene.

Also, the information on dye images obtained by photographing an original scene can be read with a scanner, and the thus read information can be reproduced as visual images. Herein, it is also possible to form a relationship other than the color complementary relationship between the wavelength regions in which emulsions have their individual sensitivities and the hues of colors developed in these emulsions. In this case, the image information taken in is subjected to some image processing, e.g., hue conversion, and thereby the original color information can be reproduced.

In reading image information with a scanner, the information on dye images can be taken in without removing developed silver and undeveloped silver halide, as well as after removing them. In the latter case, a means to remove them can be applied simultaneously with or subsequently to the development-processing. In order to remove the developed silver from the light-sensitive element and complex or solubilize the silver halide at the same time as development, a silver oxidation or re-halogenation agent functioning as a bleaching agent and a silver halide solvent functioning as a fixing agent are incorporated in advance in a processing element, and these agents are made to react with the developed silver and the undeveloped silver halide upon heat development. Also, the removal of developed silver or the complexation or solubilization of silver halide can be effected by pasting another element containing a silver oxidation or re-halogenation agent or a silver halide solvent on the photosensitive material after the development for image formation. In the present invention, it is desirable that the residual developed silver and undeveloped silver halide be reduced to an extent that they do not interfere with the reading of image information by carrying out the aforementioned processing after photographing and image forming development subsequent thereto. In particular, since the undeveloped silver halide generates an appreciable haze in the gelatin film to raise the background density of image, it is preferable to reduce the haze by complexing the undeveloped silver halide or to remove all or part of the undeveloped silver halide from the film through the solubilization. In this respect, the grains having a higher silver chloride content are of the greater advantage. This is because the light scattering and absorption in the visible region become less and the solubilization becomes easier the higher the grains are in silver chloride content to result in a greater reduction of haze.

In the present invention, it is desirable to use at least two kinds of silver halide emulsions having their individual sensitivities in the same wavelength region but differing from each other in average projected area of emulsion grains. The above expression "having their individual sensitivities in the same wavelength region" indicates that their individual sensitivities are in effectively the same wavelength region. More specifically, as far as the wavelength regions in which emulsions have their individual main sensitivity peaks overlap, these emulsions are regarded as the emulsions having their individual sensitivities in the same wavelength region even if they are subtly different in spectral sensitivity distribution. With respect to the difference in the average projected area of grains between the emulsions used, it is desirable that the average projected area of grains in one emulsion be at least 1.25 times preferably at least 1.4 times, particularly preferably at least 1.6 times, that in another eemulsion. When three or more of those emulsions are used, it is desired that the aforesaid relationship be held between the emulsion having the smallest average grain projected area and the emulsion having the greatest one.

In using two or more emulsions which have their individual sensitivities in the same wavelength region but differ in average grain projected area, these emulsions may be formed into separate light-sensitive layers, or the mixture thereof may be formed into one light-sensitive layer.

In a case where those emulsions are incorporated in separate layers, it is desirable that the emulsion having the greatest average grain projected area be incorporated in the uppermost layer (on the incidence side).

In the case of incorporating the foregoing emulsions in separate layers, it is desirable that color couplers used in combination with the emulsions have the same hue. However, it is also possible to make the hues of developed colors differ from layer to layer by using mixtures of couplers capable of forming different hues of colors, or couplers which can form colors having hues different in absorption profile can be used in separate layers, too.

The present invention will now be illustrated in more detail by reference to the following examples, but it should be understood that these examples are not to be construed as limiting the scope of the invention in any way.

EXAMPLE 1

Emulsions 1, 2 and 3 were prepared in the following manners respectively.

(1) Preparation of Emulsion 1

An aqueous solution containing 7.0 g of gelatin having an average molecular weight of 15,000 and 4.5 g of KBr in 1,200 ml of water was kept at 30° C. with stirring, and thereto aqueous $AgNO_3$ solution having a concentration of 1.9 M and aqueous KBr solution having a concentration of 1.9 M were added at a rate of 25 ml/min over a period of 70 seconds in accordance with a double jet method, thereby obtaining nuclei of tabular grains. 400 ml out of the thus obtained emulsion was used for seed crystals, and then admixed with 650 ml of an aqueous inert gelatin solution (containing 20 g of gelatin and 1.2 g of KBr), heated up to 75° C., and ripened for 40 minutes. Thereto, an aqueous solution containing 1.7 g of $AgNO_3$ was added over a period of 90 seconds, and successively 7.0 ml of a 50 wt % aqueous solution of $NH_4NO_3$ and 7.0 ml of a 25 wt % aqueous ammonia were added, and further ripened for 40 minutes.

Then, the pH of this emulsion was adjusted to 7 with $HNO_3$ (3N). After 1.0 g of KBr was added to the neutralized emulsion, 366.5 ml of aqueous $AgNO_3$ solution having a concentration of 1.9 M and an aqueous KBr solution were added, and successively 53.6 ml of aqueous $AgNO_3$ solution having a concentration of 1.9 M and aqueous KBr solution containing 33.3 mole % of KI were added, and further 160.5 ml of aqueous $AgNO_3$ solution having a concentration of 1.9 M and aqueous KBr solution were added while keeping the pAg at 7.9. Thus, Emulsion 1 was obtained.

The thus formed emulsion grains were grains having a triple layer structure wherein the highest silver iodide content region was present in the middle shell, and the average aspect ratio of these grains was 2.8. The proportion of tabular grains having an aspect ratio of 3 or above to the total emulsion grains was 26% on the projected area basis. The coefficient of variation in the grain size was 7%, and the average grain size was 0.98 $\mu$m, expressed in terms of sphere-equivalent diameter.

After the Emulsion 1 was desalted using a conventional flocculation method, each of the sensitizing dyes hereinafter set forth in Table 2 was added thereto in an amount of $4.1\times10^{-4}$ mole per mole of silver and, in the presence of each sensitizing dye, the resulting emulsion was subjected to gold-sulfur-selenium sensitization under optimum conditions.

(2) Preparation of Emulsion 2

An aqueous solution containing 7.0 g of gelatin having an average molecular weight of 15,000 and 4.5 g of KBr in 1,200 ml of water was kept at 30° C. with stirring, and thereto aqueous $AgNO_3$ solution having a concentration of 1.9 M and aqueous KBr solution having a concentration of 1.9 M were added at a rate of 25 ml/min over a period of 70 seconds in accordance with a double jet method, thereby obtaining nuclei of tabular grains. 350 ml out of the thus obtained emulsion was used for seed crystals, and then admixed with 650 ml of an aqueous inert gelatin solution (containing 20 g of gelatin and 1.2 g of KBr), heated up to 75° C., and ripened for 40 minutes. Thereto, an aqueous solution containing 1.7 g of $AgNO_3$ was added over a period of 90 seconds, and successively 6.2 ml of a 50 wt % aqueous solution of $NH_4NO_3$ and 6.2 ml of a 25 wt % aqueous ammonia were added, and further ripened for 40 minutes.

Then, the pH of this emulsion was adjusted to 7 with $HNO_3$ (3N). After 1.0 g of KBr was added to the neutralized emulsion, 366.5 ml of aqueous $AgNO_3$ solution having a concentration of 1.9 M and an aqueous KBr solution were added, and successively 53.6 ml of aqueous $AgNO_3$ solution having a concentration of 1.9 M and aqueous KBr solution containing 33.3 mole % of KI were added, and further 160.5 ml of aqueous $AgNO_3$ solution having a concentration of 1.9 M and aqueous KBr solution were added while keeping the pAg at 8.3. Thus, Emulsion 2 was obtained.

The thus formed emulsion grains were grains having a triple layer structure wherein the highest silver iodide content region was present in the middle shell, and the average aspect ratio of these grains was 6.7. The proportion of tabular grains having an aspect ratio of 6 or above to the total emulsion grains was 80% on the projected area basis, and the proportion of tabular grains having an aspect ratio of from 3 to 100 to the total emuls-ion grains was about 95% on the projected area basis. The coefficient of variation in the grain size was 11%, and the average grain size was 1.00 $\mu$m, expressed in terms of sphere-equivalent diameter.

After the Emulsion 2 was desalted using a conventional flocculation method, each of the sensitizing dyes hereinafter set forth in Table 2 was added thereto in an amount of $5.4\times10^{-4}$ mole per mole of silver and, in the presence of each sensitizing dye, the resulting emulsion was subjected to gold-sulfur-selenium sensitization under optimum conditions.

(3) Preparation of Emulsion 3

To 1.5 liter of a 0.8% low molecular (molecular weight: 10,000) gelatin solution containing 0.05 mole of potassium bromide, 15 ml of a 0.5 M silver nitrate solution and 15 ml of a 0.5 M potassium bromide solution were added over a period of 15 seconds with stirring in accordance with a double jet method. During the addition, the gelatin solution was kept at 40° C., and the pH thereof was 5.0. After the addition, the resulting solution was heated up to 75° C., admixed with 220 ml of a 10% trimellitated gelatin solution (trimellitation degree: 95%), ripened for 20 minutes and then admixed with 80 ml of a 0.47 M silver nitrate solution. After the emulsion obtained was ripened again for 10 minutes, 150 g of silver nitrate and a potassium bromide solution containing 5 mole % of potassium iodide in the amount to keep the pBr at 2.55 were added thereto at an increasing flow rate (so that the flow rate at the end was 19 times the flow rate at the beginning) in accordance with a controlled double jet method while keeping the electric potential at 0 mV. After the addition, 30 ml of a 10% KI solution was further added. Then, the resulting emulsion was adjusted to pH 7.2 by the addition of 1N NaOH. Thereto, 327 ml of a 0.5 M silver nitrate solution and 327 ml of a 0.5 M potassium bromide solution, to which 16.4 ml of $10^{-2}$ M hexacyanoferrate(II) solution was added in advance, were added over a period of 20 minutes in accordance with a double jet method while keeping the electric potential at 0 mV. Thereafter (after the shell formation), the emulsion was cooled to 35° C., and washed using a conventional flocculation method. Thereto, 80 g of deionized alkali-processed ossein gelatin and 40 ml of 2% $Zn(NO_3)_2$ were added at 40° C. After the gelatin was dissolved, the emulsion was adjusted to pH 6.5 and pAg 8.6, and stored in cold and dark room. The thus obtained Emulsion 3 comprised tabular iodobromide grains having a variation coefficient of 15% with respect to projected area circle-equivalent diameter (hereinafter referred to as "circle-equivalent diameter"), a circle-equivalent diameter of 2.5 μm, an average thickness of 0.10 μm (aspect ratio: 25) and a silver iodide content of 5.7 mole %.

After the Emulsion 3 was desalted using a conventional flocculation method, each of the sensitizing dyes hereinafter set forth in Table 2 was added thereto in an amount of $9.3\times10^{-4}$ mole per mole of silver and, in the presence of each sensitizing dye, the resulting emulsion was chemically sensitized with sodium thiosulfate, potassium chloroaurate and potassium thiocyanate at 60° C. under optimum conditions.

(4) Preparation of Emulsion-coated Samples

Samples were each prepared by coating an emulsion layer and a protective layer as shown in Table 1 on a triacetyl cellulose film support provided with an undercoat layer.

TABLE 1

Emulsion Coating Conditions

| | |
|---|---|
| (1) Emulsion Layer | |
| Emulsion 1, 2 or 3 | $2.1\times10^{-2}$ mole/m$^2$, based on Ag |
| Coupler illustrated below | $1.5\times10^{-3}$ mole/m$^2$ |
| Tricresyl phosphate | 1.10 g/m$^2$ |
| Gelatin | 2.30 g/m$^2$ |
| (2) Protective Layer | |
| Sodium 2,4-dichloro-6-hydroxy-s-triazine | 0.08 g/m$^2$ |
| Gelatin | 1.80 g/m$^2$ |

Each of these samples was subjected to an exposure for sensitometry (1/100 sec), and then to the following color photographic processing.

| Processing Step | Time | Temperature | Amount* replenished | Tank Volume |
|---|---|---|---|---|
| Color development | 2 min 45 sec | 38° C. | 33 ml | 20 l |
| Bleach | 6 min 30 sec | 38° C. | 25 ml | 40 l |
| Washing | 2 min 10 sec | 24° C. | 1200 ml | 20 l |
| Fixation | 4 min 20 sec | 38° C. | 25 ml | 30 l |
| Washing (1) | 1 min 5 sec | 24° C. | ** | 10 l |
| Washing (2) | 1 min | 24° C. | 1200 ml | 10 l |
| Stabilization | 1 min 5 sec | 38° C. | 25 ml | 10 l |
| Drying | 4 min 20 sec | 55° C. | | |

*per area measuring 1 m long by 35 mm broad
**A counter-current pipe laying system from (2) to (1)

The composition of each processing solution is described below.

Color Developer

| | Tank Solution | Replenisher |
|---|---|---|
| Diethylenetriaminepentaacetic acid | 1.0 g | 1.1 g |
| 1-Hydroxyethylidene-1,1-diphosphonic acid | 3.0 g | 3.2 g |
| Sodium sulfite | 4.0 g | 4.4 g |
| Potassium carbonate | 30.0 g | 37.0 g |
| Potassium bromide | 1.4 g | 0.7 |
| Potassium iodide | 1.5 mg | — |
| Hydroxylamine sulfate | 2.4 g | 2.8 g |
| 4-[N-ethyl-N-β-hydroxyethylamino]-2-methylaniline sulfate | 4.5 g | 5.5 g |
| Water to make | 1.0 l | 1.0 l |
| pH adjusted to | 10.05 | 10.05 |

Bleaching Bath

| | Tank Solution | Replenisher |
|---|---|---|
| Sodium ethylenediaminetetraacetato ferrate trihydrate | 100.0 g | 120.0 g |
| Disodium ethylenediaminetetraacetate | 10.0 g | 11.0 g |
| Ammonium bromide | 140.0 g | 160.0 g |
| Ammonium nitrate | 30.0 g | 35.0 g |
| Aqueous ammonia (27%) | 6.5 ml | 4.0 ml |
| Water to make | 1.0 l | 1.0 l |
| pH adjusted to | 6.0 | 5.7 |

Fixing Bath

| | Tank Solution | Replenisher |
|---|---|---|
| Sodium ethylenediaminetetraacetate | 0.5 g | 0.7 g |
| Sodium sulfite | 7.0 g | 8.0 g |
| Sodium hydrogensulfute | 5.0 g | 5.5 g |
| Ammonium thiosulfate (70% aq. soln.) | 170.0 ml | 200.0 ml |
| Water to make | 1.0 l | 1.0 l |
| pH adjusted to | 6.7 | 6.6 |

Stabilizing Bath

| | Tank Solution | Replenisher |
|---|---|---|
| Formaldehyde (37%) | 2.0 ml | 3.0 ml |
| Polyoxyethylene-p-monononylphenylether (average polymerization degree: 10) | 0.3 g | 0.45 g |
| Disodium ethylenediaminetetraacetate | 0.05 g | 0.08 g |
| Water to make | 1.0 l | 1.0 l |
| pH adjusted to | 5.8–8.0 | 5.8–8.0 |

The density measurement of the thus processed samples each was made via a green filter, and thereby the fresh sensitivity and fog of each sample were evaluated. The evaluation results are shown in Table 2.

Herein, the sensitivity is determined as the reciprocal of the exposure amount required-for providing a density of fog +0.2. The sensitivities shown in Table 2 are relative values, with Sample 1-1, Sample 2-1 and Sample 3-1 each being taken as 100. In Table 2, which of the emulsions and which of the methine compounds were used in each sample are also shown.

TABLE 2

| | Emulsion 1 | | Emulsion 2 | | Emulsion 3 | |
|---|---|---|---|---|---|---|
| Methine Compound | Sample No. | Sensitivity | Sample No. | Sensitivity | Sample No. | Sensitivity |
| S-1 | 1-1 | 100* | 2-1 | 100* | 3-1 | 100* |
| (80) | 1-2 | 105 | 2-2 | 125 | 3-2 | 145 |
| (70) | 1-3 | 110 | 2-3 | 130 | 3-3 | 151 |
| (83) | 1-4 | 112 | 2-4 | 131 | 3-4 | 154 |
| (99) | 1-5 | 103 | 2-5 | 125 | 3-5 | 144 |
| (106) | 1-6 | 104 | 2-6 | 123 | 3-6 | 146 |
| (1) | 1-7 | 115 | 2-7 | 137 | 3-7 | 171 |
| (5) | 1-8 | 114 | 2-8 | 137 | 3-8 | 170 |
| (6) | 1-9 | 116 | 2-9 | 135 | 3-9 | 170 |
| (48) | 1-10 | 120 | 2-10 | 141 | 3-10 | 185 |
| (32) | 1-11 | 119 | 2-11 | 145 | 3-11 | 183 |
| (14) | 1-12 | 121 | 2-12 | 148 | 3-12 | 190 |
| (51) | 1-13 | 110 | 2-13 | 137 | 3-13 | 170 |
| (62) | 1-14 | 111 | 2-14 | 136 | 3-14 | 169 |

*Standard

S-1 (Comparative dye)

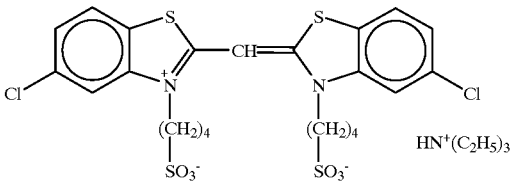

As can be seen from Table 2, although the present methine compounds are little better than the comparative dye S-1 with respect to the sensitivity increasing effect in case of the Emulsion 1 having a low aspect ratio, they conferred markedly high sensitivities on the Emulsions 2 and 3 having high aspect ratios, compared with the comparative dye.

EXAMPLE 2

Preparation of Pure Silver Chloride Grains having Regular Crystal Shape

To 1 l of water placed in a vessel, 4.8 g of sodium chloride and 30 g of inert gelatin were added, and kept at 60° C. with stirring. Thereto, 600 ml of an aqucontainingion containing 21.3 g of silver nitrate and 600 ml of an aqueous solution containing 7.74 g of sodium chloride were added over a period of 20 minutes in accordance with a double jet method. After a 5-minute lapse from the end of addition, each of the crystal habit control agents set forth in Table 3 was added. After a 5-minute lapse from the addition of each crystal habit control agent, 300 ml of an aqueous solution containing 112.5 g of silver nitrate and 300 ml of an aqueous solution containing 40.14 g of sodium chloride were further added over a period of 60 minutes.

At the conclusion of the addition, the resulting emulsion was admixed with $4.0\times10^{-3}$ mole/mole Ag of potassium thiocyanate at 60° C. After a 10-minute lapse, it was further admixed with $5\times10^{-4}$ mole/mole Ag of each of the sensitizing dyes set forth in Table 3, and heated up to 75° C. The resulting emulsion was stirred for additional 10 minutes.

After cooling to 40° C., the emulsion obtained was admixed with an aqueous solution containing Sedimentation Agent-1 illustrated below to make the total volume 3.5 l, and the pH thereof was lowered with sulfuric acid to result in the precipitation of silver halide (at pH 3.8). Therefrom, 83% of the supernatant (S1) was removed (first washing). Then, distilled water was added in the same amount as the supernatant removed, and further sulfuric acid was added till the silver halide was precipitated. Again, 83% of the supernatant (S2) was removed (second washing). Further, distilled water was added in the same amount as the supernatant removed, and sulfuric acid was added again till the silver halide was precipitated. Once more, 83% of the supernatant (S3) was removed (third washing) to conclude the desalting process.

Sedimentation Agent-1

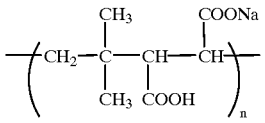

average molecular weight: 120,000

To the thus desalted emulsion, 67 g of gelatin, 80 ml of phenol (5%) and 150 ml of distilled water were added. Further, the resulting emulsion was adjusted to pH 6.2 and pAg 7.5 by the use of sodium hydroxide and silver nitrate solutions. Thus, pure silver chloride emulsions (Emulsions R1 to R16 shown in Table 3) was obtained. The emulsion grains therein had an average sphere equivalent diameter of 0.55 μm.

TABLE 3

| Emulsion | Crystal Habit Control Agent (amount added in mole/mole Ag) | Grain Shape | Sensitizing Dye |
|---|---|---|---|
| R1 | blank | cube | A |
| R2 | " | " | B |
| R3 | " | " | C |

TABLE 3-continued
| | | | |
|---|---|---|---|
| R4 | " | " | D |
| R5 | 1 (3.0 × $10^{-3}$) | octahedron | A |
| R6 | " | " | B |
| R7 | " | " | C |
| R8 | " | " | D |
| R9 | 23 (1.5 × $10^{-3}$) | octahedron | A |
| R10 | " | " | B |
| R11 | " | " | C |
| R12 | " | " | D |
| R13 | 31 (3.0 × $10^{-3}$) | octahedron | A |
| R14 | " | " | B |
| R15 | " | " | C |
| R16 | " | " | D |
| R17 | 1 (3.0 × $10^{-3}$) | tetradecahedron | A |
| R18 | " | " | B |
| R19 | " | " | C |
| R20 | " | " | D |
Crystal Habit Control Agent-31
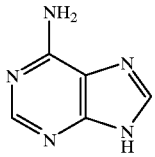
Sensitizing Dye A [conventional one]
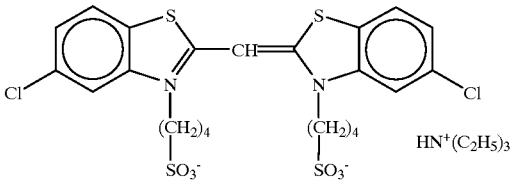
Sensitizing Dye B [conventional one]
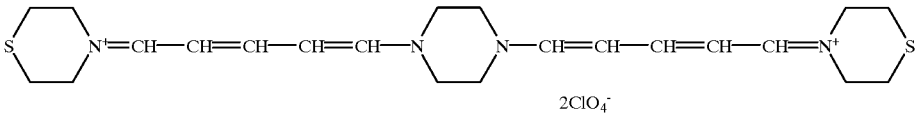
Sensitizing Dye C [Compound of formula (III)]
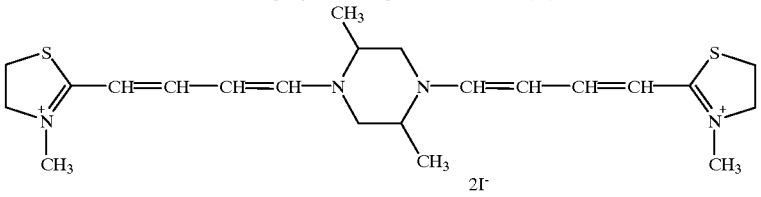
Sensitizing Dye D [Compound of formula (III)]
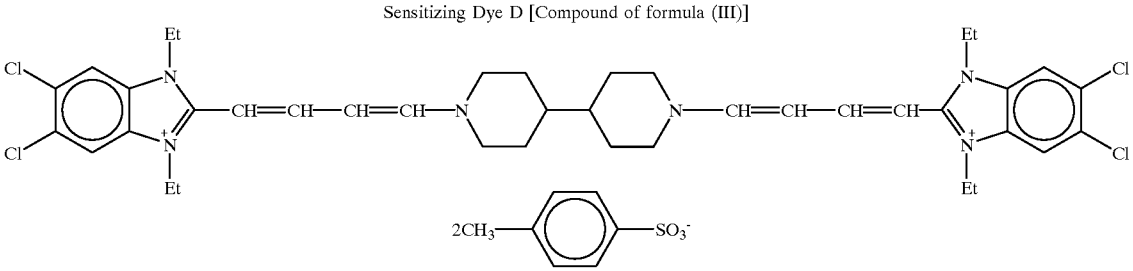

Preparation of Pure Silver Chloride Grains having Tetradecahedral Crystal Shape

Emulsions (R17 to R20 set forth in the above Table 3) were prepared in the same manner as the foregoing Emulsions R5 to R8, except that the crystal habit control agent-1 was added at the time when the amount of silver nitrate added became 50 g.

The emulsion grains obtained were tetradecahedral grains having an average sphere-equivalent diameter of 0.55 μm, and 60% of the outer surface of each grain was constituted of (111) faces.

Chemical Sensitization

Each of the Emulsions Rl to R20 was chemically sensitized at 60° C. using 4-hydroxy-6-methyl-1,3,3a,7-tetraazaindene, sodium thiosulfate and chloroauric acid under optimum conditions.

Preparation of Emulsion-coated Samples

In preparing samples for evaluation of photographic characteristics, the Emulsions R1 to R20 chemically sensitized in the foregoing manner were each used in the amount of 1,300 g (corresponding to a silver content of 1 mole), and thereto the following ingredients were added:

| | |
|---|---|
| 14% Aqueous solution of inert gelatin | 756 g |
| Sodium 1-(3-sulfophenyl)-5-mercaptotetrazole | 0.129 g |
| Sodium dodecylbenzenesulfonate | 1.44 g |
| Sodium polystyrenesulfonate (average molecular weight: 600,000) | 1.44 g |
| Water to make the total amount | 4,860 ml |

Each of the thus made coating solutions and a coating solution for surface protective layer were coated using a simultaneous extrusion method so as to have a silver coverage of 1.60 g/m$^2$ to prepare coated Samples Rt1 to Rt20.

Evaluation of Photographic Characteristics

The coated Samples Rt1 to Rt20 were each exposed for 1 second using a light source having a color temperature of 2854 °K via a filter transmitting light of wavelengths longer than 420 nm. Thereafter, each sample was developed with the following Developer D19 at 20° C. for 5 minutes, fixed for 30 seconds with a fixer, Super Fuji Fix (made by Fuji Photo Film Co., Ltd.), washed and then dried.

Developer D19

| | |
|---|---|
| Metol | 2.2 g |
| $Na_2SO_3$ | 96 g |
| Hydroquinone | 8.8 g |
| $NaCO_3 \cdot H_2O$ | 56 g |
| KBr | 5 g |

The results of sensitometry are shown in Table 4. Therein, the standard point of the optical density to determine the sensitivity is fog +0.1, and the sensitivities are shown as relative values, with the Sample Rt1 being taken as 100.

TABLE 4

| Sample | Emulsion | Relative sensitivity | Fog | Remarks |
|---|---|---|---|---|
| Rt1 | R1 | 100 | 0.04 | comparison |
| Rt2 | R2 | 93 | 0.04 | comparison |
| Rt3 | R3 | 100 | 0.04 | comparison |
| Rt4 | R4 | 102 | 0.03 | comparison |
| Rt5 | R5 | 124 | 0.03 | comparison |
| Rt6 | R6 | 120 | 0.03 | comparison |
| Rt7 | R7 | 145 | 0.02 | invention |
| Rt8 | R8 | 161 | 0.03 | invention |

TABLE 4-continued

| Sample | Emulsion | Relative sensitivity | Fog | Remarks |
|---|---|---|---|---|
| Rt9 | R9 | 115 | 0.03 | comparison |
| Rt10 | R10 | 111 | 0.03 | comparison |
| Rt11 | R11 | 140 | 0.02 | invention |
| Rt12 | R12 | 148 | 0.02 | invention |
| Rt13 | R13 | 105 | 0.02 | comparison |
| Rt14 | R14 | 102 | 0.02 | comparison |
| Rt15 | R15 | 118 | 0.02 | invention |
| Rt16 | R16 | 122 | 0.02 | invention |
| Rt17 | R17 | 120 | 0.03 | comparison |
| Rt18 | R18 | 120 | 0.04 | comparison |
| Rt19 | R19 | 132 | 0.03 | invention |
| Rt20 | R20 | 145 | 0.03 | invention |

As can be seen from Table 4, every emulsion comprising octahedral or tetradecahedral grains having (111) faces at their outer surfaces provided low fog and high sensitivity, compared with the emulsions comprising cubic grains having (100) faces at their outer surfaces. In particular, the emulsions prepared in accordance with the present invention had high sensitivities. Further, the sensitivity increasing effect of the present invention was remarkable in the (111) AgCl emulsions made using a pyridinium salt represented by formula (V), (VI) or (VII) as crystal habit control agent.

EXAMPLE 3

Preparation of (100) AgClBr Tabular Grains

In a reaction vessel, 1,200 ml of an aqueous gelatin solution having the pH 4.3, wherein 25 g of deionized alkali-processed ossein gelatin containing a methionine content of about 40 μmole/g, 1 g of sodium chloride and 4.5 ml of 1N nitric acid were contained, was placed and heated up to 40° C. To this solution with vigorous stirring, 36 ml out of 100 ml of an aqueous solution (A) containing 20 g of silver nitrate and 36 ml out of 100 ml of an aqueous solution (B) containing 0.71 g of potassium bromide and 6.67 g of sodium chloride were added simultaneously over a 45-second period. After the addition, the resulting mixture was stirred for additional 3 minutes, and thereto 43.4 ml out of 100 ml of an aqueous solution (C) containing 1.1 g of potassium bromide was further added over 30-second period. After 3 minutes were taken to cool the mixture to 30° C., the cooled mixture was. kept at that temperature. Thereto, 108 ml of Solution (A) and 108 ml of a solution (D) prepared by dissolving 7.02 g of sodium chloride in water to make the total volume 100 ml were added simultaneously over a 2.25-minute period with stirring. After the stirring was continued for additional 1 minute, 20 ml of a 10 % sodium chloride solution and 7 ml of a 1N aqueous solution of sodium hydroxide were added thereto, and thereby the pH was adjusted to 6.5 and the silver potential was adjusted to 80 mV with reference to the saturated calomel electrode. Then, the resulting solution was admixed with 2 ml of aqueous hydrogen peroxide solution (35%), heated up to 75° C., and ripened for 5 minutes. Thereto, 1086 g (silver content: 108.7 g) of an emulsion comprising cubic silver chlorobromide grains having an average edge length of 0.06 μm and a silver bromide content of 5 mole % was added over a 45-minute period while keeping the silver potential at 140 mV. After the addition, 27 ml of 1% potassium thiocyanate and $4.5 \times 10^{-4}$ mole/mole Ag of a sensitizing dye as set forth in Table 3 were further added, and the stirring was continued for 10 minutes. Then, the resulting emulsion was cooled to 35° C., and desalted in a conventional manner.

The thus obtained emulsions were emulsions (comparable to Emulsions Σ1 to Σ4 set forth in Table 5) comprising (100)

silver chlorobromide tabular grains having an average sphere-equivalent diameter of 0.92 μm, an average grain thickness of 0.128 μm, an aspect ratio of 15.9 and a silver bromide content of 5 mole %.

Preparation of Emulsions comprising (111) Pure AqCl Tabular Grains

To 1.2 l of water placed in a vessel, 2.0 g of sodium chloride and 2.4 g of inert gelatin were added, and kept at 35° C. with stirring. Thereto, 60 ml of an aqueous solution containing 9 g of silver nitrate and 60 ml of an aqueous solution containing 3.2 g of sodium chloride were added over a period of 1 minutes in accordance with a double jet method. After a 1-minute lapse from-the end of addition, the crystal habit control agent-1 was added in an amount of 1 millimole. After a 1-minute lapse, 3.0 g of sodium chloride was added thereto. Then, the temperature of the reaction vessel was heated up to 60° C. over a 25-minute period, and the ripening at 60° C. was continued for 16 minutes. Then, 290 g of a 10% aqueous solution of phthaloylated gelatin was added thereto. Thereafter, 754 ml of an aqueous solution containing 113 g of silver nitrate and 768 ml of an aqueous solution containing 41.3 g of sodium chloride were further added at an increasing flow rate over a 40-minute period. In the course of this addition, 34 ml of a 10% aqueous solution of KBr was added at the time when 37 minutes was passed from the beginning of the addition, and 30 ml of a 0.025 M NaCl aqueous solution containing 11 mg of a hexacyanoferrate(III) was also added through 30-minute lapse to 40-minute lapse from the beginning of the addition.

At the conclusion of the addition, the resulting emulsion was admixed with 27 ml of a 1% potassium thiocyanate and each of the sensitizing dyes set forth in Table 3 in an amount of $4.5\times10^{-4}$ mole/mole Ag, heated up to 75° C., and stirred for 10 minutes.

After cooling to 40° C., the emulsion obtained was admixed with an aqueous solution containing 0.3 g of the sedimentation agent-1 to make the total volume 3.5 l, and washed using the same flocculation method as adopted in Example 2.

To the thus washed emulsion, 67 g of gelatin, 80 ml of phenol (5%) and 150 ml of distilled water were added. Further, the resulting emulsion was adjusted to pH 6.2 and pAg 7.5 by the use of sodium hydroxide and silver nitrate solutions. Thus, pure silver chloride emulsions (comparable to Emulsions Σ5 to Σ8 shown in Table 5) were obtained. The emulsion grains therein were tabular grains having an average sphere-equivalent diameter of 0.85 μm and an average thickness of 0.14 μm.

Preparation of Emulsions Comprising (111) Pure AgCl Tabular Grains

Emulsions (comparable to Emulsions Σ9 to Σ12 shown in Table 5) were each prepared in the same manner as mentioned above, except that 1.44 millimole of the crystal habit control agent-31 was used in place of 1 millimole of the crystal habit control agent-1. The grains in those emulsions had an average sphere-equivalent diameter of 0.85 μm and an average thickness of 0.14 μm.

TABLE 5

| Emulsion | Crystal Habit Control Agent (amount added in mole/mole Ag) | Grain Shape | Sensitizing Dye |
|---|---|---|---|
| Σ1 | blank | (100) tabular | A |
| Σ2 | " | " | B |
| Σ3 | " | " | C |

TABLE 5-continued

| Emulsion | Crystal Habit Control Agent (amount added in mole/mole Ag) | Grain Shape | Sensitizing Dye |
|---|---|---|---|
| Σ4 | " | " | D |
| Σ5 | 1 ($3.0\times10^{-3}$) | (111) tabular | A |
| Σ6 | " | " | B |
| Σ7 | " | " | C |
| Σ8 | " | " | D |
| Σ9 | 31 ($3.0\times10^{-3}$) | (111) tabular | A |
| Σ10 | " | " | B |
| Σ11 | " | " | C |
| Σ12 | " | " | D |

The emulsions thus prepared were each chemically sensitized at 60° C. using 4-hydroxy-6-methyl-1,3,3a,7-tetraazaindene, sodium thiosulfonate, sodium thiosulfate, Selenium Compound-1, chloroauric acid and Compound-1 under optimum conditions to obtain Emulsions Σ1 to Σ12.

Selenium Compound-1

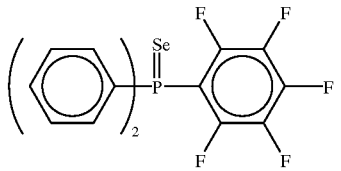

Compound-1

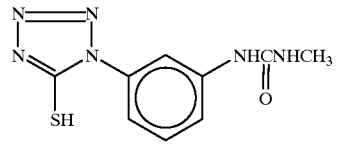

Preparation of Emulsion-coated Samples for Heat Development

Samples for heat development were prepared using Emulsions Σ1 to Σ12 respectively in the following manner.

First, a zinc hydroxide dispersion used as a base precursor upon heat development was prepared as follows: In 158.5 ml of water, 31 g of a-zinc hydroxide powder (size of primary particles: 0.2 μm), a dispersant constituted of 1.6 g of carboxymethyl cellulose and 0.4 g of sodium polyacrylate, 8.5 g of lime-processed ossein gelatin were mixed and dispersed for 1 hour by means of a mill using glass beads. After dispersing them, the glass beads were filtered out to yield 188 g of a zinc hydroxide dispersion.

Then, a dispersion of cyan coupler (a) was prepared as follows: 10.7 g of a cyan coupler (a), 5.45 g of a developing agent (b), 2 mg of an antifoggant (c), 8.21 g of a high boiling organic solvent (d) and 24 ml of ethyl acetate were mixed at 60° C. to make a solution. This solution was mixed with 150 g of an aqueous solution containing 12 g of lime-processed gelatin and 0.6 g of sodium dodecylbenzenesulfonate, and emulsified and dispersed by 20 minutes' stirring at 10,000 r.p.m. by means of a dissolver. To the thus obtained dispersion, distilled water was added to make the total volume 300 g, followed by 10 minutes' mixing at 2,000 r.p.m.

Cyan Coupler (a)

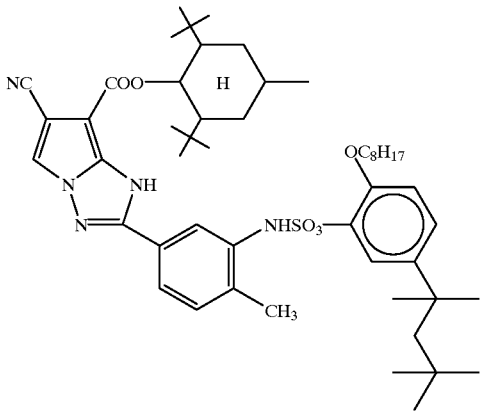

Developing Agent (b)

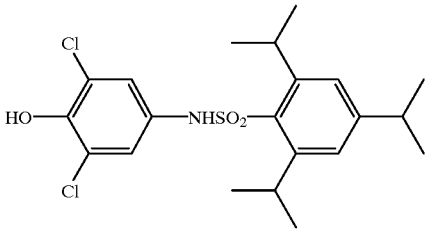

Antifoggant (c)

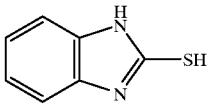

High Boiling Organic Solvent (d)

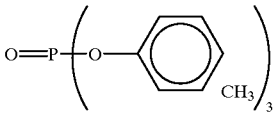

These ingredients, each of the silver halide emulsions prepared in advance (Emulsions Σ1 to Σ12) and the other ingredients as shown in Table 6 were combined properly to prepare coating compositions set forth in Table 6. By the use of these coating compositions, heat developable samples Σt1 to Σt12 were made. The layers set forth in Table 6 were coated on a transparent polyethylene terephthalate support having a thickness of 120 μm.

TABLE 6

| Layer | Coating Composition | Coverage (mg/m$^2$) |
|---|---|---|
| Protective layer | Lime-processed gelatin | 1000 |
| | Matting agent (silica) | 50 |
| | Surfactant (f) | 100 |
| | Surfactant (g) | 300 |
| | Water-soluble polymer (h) | 15 |
| | Hardener (i) | 40 |
| Interlayer | Lime-processed gelatin | 375 |
| | Surfactant (g) | 15 |
| | Zinc hydroxide | 1100 |
| | Water-soluble polymer (h) | 15 |
| Emulsion layer | Lime-processed gelatin | 2000 |
| | Emulsion (based on silver) | 1726 |
| | Cyan coupler (a) | 872 |
| | Developing agent (b) | 444 |
| | Antifoggant (c) | 0.20 |

TABLE 6-continued

| | | |
|---|---|---|
| | High boiling organic solvent (d) | 670 |
| | Surfactant (e) | 33 |
| | Water-soluble polymer (h) | 14 |

Surfactant (e)

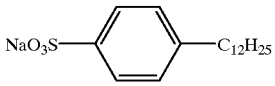

Surfactant (f)

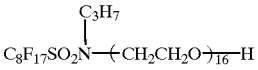

Surfactant (g)

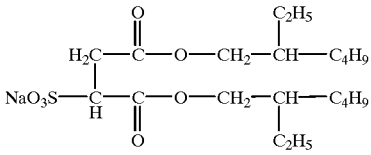

Water-soluble Polymer (h)

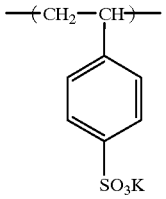

Hardener (i)

$CH_2{=}CH{-}SO_2{-}CH_2{-}SO_2{-}CH{=}CH_2$

Further, a processing material P-1 shown in Table 7 was prepared.

TABLE 7

| Layer Structure | Ingredients added | Coverage (mg/m$^2$) |
|---|---|---|
| Fourth layer (Protective layer) | Acid-processed gelatin | 220 |
| | Water-soluble polymer (j) | 60 |
| | Water-soluble polymer (k) | 200 |
| | Additive (l) | 80 |
| | Palladium sulfide | 3 |
| | Potassium nitrate | 12 |
| | Matting agent (m) | 10 |
| | Surfactant (g) | 7 |
| | Surfactant (n) | 7 |
| | Surfactant (o) | 10 |
| Third layer (Interlayer) | Lime-processed gelatin | 240 |
| | Water-soluble polymer (k) | 24 |
| | Hardener (p) | 180 |
| | Surfactant (e) | 9 |
| Second layer (Base generating layer) | Lime-processed gelatin | 2400 |
| | Water-soluble polymer (k) | 360 |
| | Water-soluble polymer (q) | 70Q |
| | Water-soluble polymer (r) | 600 |
| | High boiling solvent (s) | 2000 |
| | Additive (t) | 20 |
| | Potassium hydantoin | 260 |
| | Guanidine picolate | 2910 |
| | Potassium quinolinate | 225 |
| | Sodium quinolinate | 180 |
| | Surfactant (e) | 24 |

TABLE 7-continued

| | | |
|---|---|---|
| First layer (Undercoat layer) | Lime-processed gelatin | 280 |
| | Water-soluble polymer (j) | 12 |
| | Surfactant (g) | 14 |
| | Hardener (p) | 185 |

Transparent support A (63 μm)

Water-soluble polymer (j): K-carrageenan
Water-soluble polymer (k): Sumikagel L-5H (produced by Sumitomo Chemical Co., Ltd.)

Additive (1)

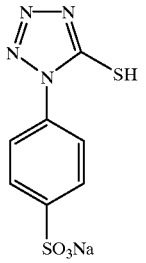

Matting agent (m)
SYLOID 79 (produced by Fuji Davison Co.)

Surfactant (n)

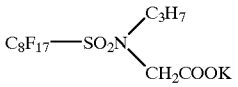

Surfactant (o)

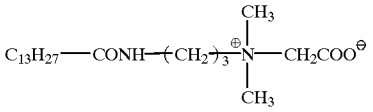

Hardener (p)

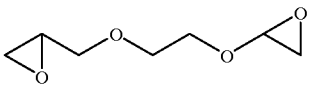

Water-soluble polymer (q)
Dextran (molecular weight: 70,000)
Water-soluble polymer (r)
MP Polymer MP102 (produced by Kuraray Co., Ltd.)
High boiling solvent (s)
Enpara 40 (produced by Ajimonoto Co., Inc.)
Additive (t)

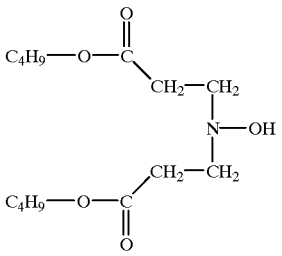

Each of those photosensitive materials was subjected to 1/100 second exposure via an optical wedge and a blue filter. After the exposure, 15 ml/m$^2$ of 40° C. water was applied to the surface of each photosensitive material, and then brought into face-to-face contact with the processing material P-1, and further thermally developed at 83° C. for 30 seconds by means of a heat drum. After development, each photosensitive material was peeled apart, and therein a wedge-form cyan image was obtained.

Each of these color-developed samples was stabilized using a processing material-P-2 shown in Table 8.

TABLE 8

| Layer Structure | Ingredients added | Coverage (mg/m$^2$) |
|---|---|---|
| Fourth layer | Acid-processed gelatin | 180 |
| | Water-soluble polymer (j) | 60 |
| | Water-soluble polymer (k) | 200 |
| | Potassium nitrate | 12 |
| | Matting agent (m) | 10 |
| | Surfactant (g) | 7 |
| | Surfactant (n) | 7 |
| | Surfactant (o) | 10 |
| Third layer | Lime-processed gelatin | 240 |
| | Water-soluble polymer (k) | 24 |
| | Hardener (p) | 180 |
| | Surfactant (e) | 9 |
| Second layer | Lime-processed gelatin | 2400 |
| | Water-soluble polymer (k) | 120 |
| | Water-soluble polymer (q) | 700 |
| | Water-soluble polymer (r) | 600 |
| | High boiling solvent (s) | 2000 |
| | Additive (A) | 1270 |
| | Additive (B) | 683 |
| | Surfactant (e) | 20 |
| First layer | Gelatin | 190 |
| | Water-soluble polymer (j) | 12 |
| | Surfactant (g) | 14 |
| | Hardener (p) | 185 |
| | Transparent support A (63 μm) | |

Additive A

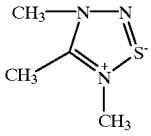

Additive B

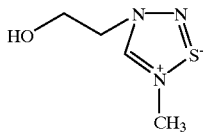

The transparent support A used above had the layer structure shown in Table 9.

TABLE 9

| Layer | Composition | Weight (mg/m$^2$) |
|---|---|---|
| Undercoat layer on surface side | Gelatin | 100 |
| Polymer layer | Polyethylene terephthalate | 62500 |
| Undercoat layer on back side | Methylmethacrylate-styrene-2-ethylhexylacrylate-methacrylic acid copolymer | 1000 |
| | PMMA (polymethylmethacrylic acid) latex (average particle size: 12 μm) | 120 |
| | | 63720 |

The stabilization processing was effected by applying 10 ml/M$^2$ of water to the processing material P-2, bring it into face-to-face contact with each of the color-developed samples, and then heating them at 60° C. for 30 seconds.

Each of the thus obtained color-developed samples was examined for transmission densities to determine the so-called characteristic curve. Herein, the sensitivity is determined as the reciprocal of an exposure amount required for providing a density of fog +0.15. The results obtained are shown in Table 10. The sensitivities shown in Table 10 are relative values, with Sample Σt1 being taken as 100. And the fog densities therein are also relative values, with the maximum density being taken as 1.

TABLE 10

| Sample | Emulsion | Relative Sensitivity | Fog | Remarks |
|---|---|---|---|---|
| Σt1 | Σ1 | 100 | 0.18 | comparison |
| Σt2 | Σ2 | 86 | 0.22 | comparison |
| Σt3 | Σ3 | 104 | 0.18 | comparison |
| Σt4 | Σ4 | 110 | 0.20 | comparison |
| Σt5 | Σ5 | 111 | 0.11 | comparison |
| Σt6 | Σ6 | 101 | 0.10 | comparison |
| Σt7 | Σ7 | 143 | 0.09 | invention |
| Σt8 | Σ8 | 155 | 0.10 | invention |
| Σt9 | Σ9 | 87 | 0.12 | comparison |
| Σt10 | Σ10 | 90 | 0.10 | comparison |
| Σt11 | Σ11 | 112 | 0.09 | invention |
| Σt12 | Σ12 | 135 | 0.09 | invention |

The data set forth in Table 10 indicate the following:

1) Samples (Σt5 to Σt12) comprising tabular grains the outer surfaces of which were constituted mainly of (111) faces had lower fog densities than Samples (Σt1 to Σt4) comprising tabular grains the outer surfaces of which were constituted of (100) faces.

2) The use of sensitizing dyes according to the present invention enables the achievement of high sensitivity without increasing the fog density.

3) The sensitivity increasing effects of sensitizing dyes according to the present invention were remarkable in Samples Σt8 and Σt9 comprising (111) AgCl tabular grains formed by the use of a crystal habit control agent according to the present invention, namely a pyridinium salt (in comparison with Samples Σt11 and Σt12 comprising (111) AgCl grains formed by the use of a conventional crystal habit control agent 31).

EXAMPLE 4

An emulsion layer and a protective layer were coated on a cellulose triacetate film support provided with an undercoat layer under the following conditions:

(1) Emulsion Layer

| | |
|---|---|
| Each of the same Emulsions Σ1 to Σ12 as prepared in Example 3 | silver $3.6 \times 10^{-2}$ mole/m$^2$ |
| Coupler: 1-(2,4,6-trichlorophenyl)-3-{3-(α-2,4-di-t-amino-phenoxy)butanamido}-benzamido-5-pyrazolone | $1.5 \times 10^{-3}$ mole/m$^2$ |
| Tricresyl phosphate | 1.10 g/m$^2$ |
| Gelatin | 2.30 g/m$^2$ |

(2) Protective Layer

| | |
|---|---|
| Sodium 2,4-dichloro-6-hydroxy-s-triazine | 0.08 g/m$^2$ |
| Gelatin | 1.80 g/m$^2$ |

Each of the thus prepared samples was allowed to stand for 14 hours at 40° C. under a relative humidity of 70%, and then subjected to 1/10 second exposure via a yellow filter and a continuous wedge. Thereafter, the following color photographic processing was performed:

| Processing Step | Processing Time | Processing Temperature |
|---|---|---|
| Color development | 2 min 00 sec | 40° C. |
| Bleach-fix | 3 min 00 sec | 40° C. |
| Washing (1) | 20 sec | 35° C. |
| Washing (2) | 20 sec | 35° C. |
| Stabilization | 20 sec | 35° C. |
| Drying | 50 sec | 65° C. |

The composition of each processing solution is described below.

Color Developer

| | |
|---|---|
| Diethylenetriaminepentaacetic acid | 2.0 g |
| Sodium 1-hydroxyethylidene-1, 1-disulfonsulfite | 4.0 g |
| Potassium carbonate | 30.0 g |
| Potassium bromide | 1.4 g |
| Potassium iodide | 1.5 mg |
| Hydroxyamine sulfate | 2.4 g |
| 4-[N-Ethyl-N-β-hydroxyethylamino]-2-methyl-aniline sulfate | 4.5 g |
| Water to make | 1.0 l |
| pH adjusted to | 10.05 |

Bleach-Fix Bath

| | |
|---|---|
| Ammonium ethylenediaminetetraacetato ferrate dihydrate | 90.0 g |
| Disodium ethylenediaminetetraacetate | 5.0 g |
| Sodium sulfite | 12.0 g |
| Aqueous ammonium thiosulfate solution (70%) | 260.0 ml |
| Acetic acid (98%) | 5.0 ml |
| 2-Mercapto-1,3,4-triazole | 0.01 mole |
| Water to make | 1.0 l |
| pH adjusted to | 6.0 |

Washing Bath

City water was passed through a mixed-bed column packed with an H-type cation exchange resin (Amberlite IR-120B, produced by Rohm & Haas Co.) and an OH-type anion exchange resin (Amberlite IR-400, produced by Rohm & Hass Co.) to reduce calcium and magnesium concentrations each to 3 mg/l or below, and then admixed with 20 mg/l of sodium dichloroisocyanurate and 1.5 g/l of sodium sulfate. The pH of the resulting water was in the range of 6.5 to 7.5.

Stabilizing Bath

| | |
|---|---|
| Formaldehyde (37%) | 2.0 ml |
| Polyoxyethylene-p-monononylphenylether (average polymerization degree: 10) | 0.3 g |
| Disodium ethylenediaminetetraacetate | 0.05 g |
| Water to make | 1.0 l |
| pH adjusted to | 5.0–8.0 |

The thus processed samples were evaluated by relative sensitivities thereof. Therein, each sensitivity was determined as the logarithm of the reciprocal of an exposure amount (expressed in lux.sec) required for providing the density of fog +0.1. As a result, the samples using emulsions according to the present invention have proved to have high sensitivity and reduced fog. In particular, the samples using the emulsions made in the presence of the crystal habit control agent 1 were superior in sensitivity.

While the invention has been described in detail and with reference to specific embodiments thereof, it will be apparent to one skilled in the art that various changes and modifications can be made therein without departing from the spirit and scope thereof.

What is claimed is:

1. A silver halide photographic material comprising a support having provided thereon at least one light-sensitive silver halide emulsion layer, said emulsion layer comprising silver halide grains having an aspect ratio in the range of 3 to 100 and at least one compound represented by the following formula (III) or (IV):

(III)

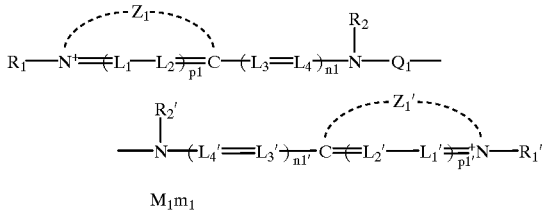

wherein $Z_1$ represents atomic-groups required for forming a 5- or 6-membered nitrogen-containing heterocyclic ring, $R_1$ and $R_2$ each represents an alkyl group, an aryl group or a heterocyclic group, $L_1$, $L_2$, $L_3$ and $L_4$ each represents a methine group, $n_1$ represents 0, 1, 2, 3 or 4, $p_1$ represents 0 or 1, $M_1$ represents a counter ion for adjusting the balance of charge, and $m_1$ represents the number of counter ions required for neutralizing the charges in a molecule, which is from 0 to 10, $Q_1$ represents a divalent linking group or a single bond, and $Z_1'$, $R_1'$, $R_2'$, $L_1'$, $L_2'$, $L_3'$, $L_4'$, $p_1'$ and $n_1'$ have the same meanings as $Z_1$, $R_1$, $R_2$, $L_1$, $L_2$, $L_3$, $L_4$, $p_1$ and $n_1$, respectively;

(IV)

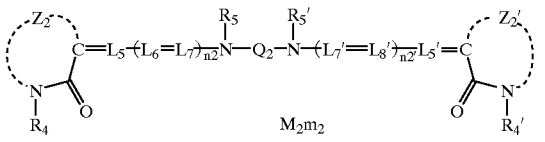

wherein $Z_2$ represents atomic groups required for completing an acidic nucleus, $R_4$ and $R_5$ each represents an alkyl group, an aryl group or a heterocyclic group, $L_5$, $L_6$ and $L_7$ each represents a methine group, $n_2$ represents 0, 1, 2, 3 or 4, $M_2$ represents a counter ion for adjusting the balance of charge, and $m_2$ represents the number of counter ions required for neutralizing the charges in a molecule, which is from 0 to 10, $Q_2$ represents a divalent linking group or a single bond, and $Z_2'$, $R_4'$, $R_5'$, $L_5'$, $L_6'$, $L_7'$ and $n_2'$ have the same meanings as $Z_2$, $R_4$, $R_5$, $L_5$, $L_6$, $L_7$ and $n_2$, respectively;

and wherein said silver halide grains at least 50%, based on projected area, of which are grains having a silver chloride content of at least 50 mole % and an outer surface at least 50% of which is constituted of (111) faces.

2. The silver halide photographic material as claimed in claim 1, wherein the aspect ratio of said silver halide grains is from 3 to 50.

3. The silver halide photographic material as claimed in claim 1, wherein the aspect ratio of said silver halide grains is from 5 to 50.

4. The silver halide photographic material as claimed in claim 1, wherein said silver halide grains are grains formed in the presence of at least one compound selected from the compounds represented by the following formula (V), (VI) or (VII):

(V)

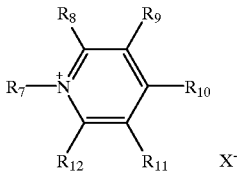

wherein $R_7$ represents an alkyl group, an alkenyl group or an aralkyl group, $R_8$, $R_9$, $R_{10}$, $R_{11}$ and $R_{12}$ each represents a hydrogen atom or a substituent group, or a condensed ring may be formed by combining $R_8$ with $R_9$, $R_9$ with $R_{10}$, $R_{10}$ with $R_{11}$, or $R_{11}$ with $R_{12}$, provided that at least one of the substituent groups $R_8$ to $R_{12}$ represents an aryl group, and $X^-$ represents a counter anion;

(VI)

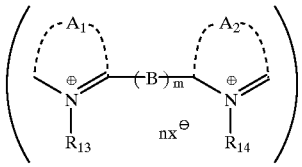

(VII)

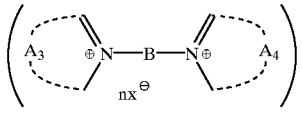

wherein $A_1$, $A_2$, $A_3$ and $A_4$, which may be the same or different, each represents a non-metal atomic group required for completing a nitrogen-containing heterocyclic ring, B represents a divalent linking group, m represents 0 or 1, $R_{13}$ and $R_{14}$ each represents an alkyl group, X represents an anion, and n represents 0 or 1, but n is 0 when the compound forms an inner salt.

5. The silver halide photographic material as claimed in claim 4, wherein said silver halide grains comprises tabular grains having an aspect ratio of at least 5 and (111) faces as their main outer surface.

6. A silver halide photographic material comprising a support having provided thereon an emulsion layer, said emulsion layer comprising silver halide grains having an aspect ratio in the range of 3 to 100 and at least one compound represented by the following formula (III) or (IV):

(III)

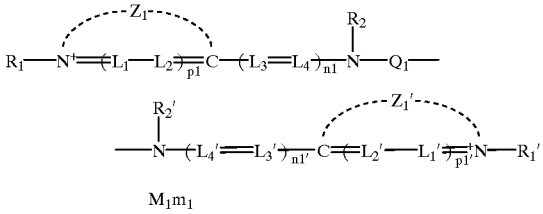

wherein $Z_1$ represents atomic-groups required for forming a 5- or 6-membered nitrogen-containing heterocyclic ring, $R_1$ and $R_2$ each represents an alkyl group, an aryl group or a heterocyclic group, $L_1$, $L_2$, $L_3$ and $L_4$ each represents a methine group, $n_1$ represents 0, 1, 2, 3 or 4, $p_1$ represents 0 or 1, $M_1$ represents a counter ion for adjusting the balance of charge, and $m_1$ represents the number of counter ions required for neutralizing the charges in a molecule, which is from 0 to 10, $Q_1$ represents a divalent linking group or a single bond, and $Z_1'$, $R_1'$, $R_2'$, $L_1'$, $L_2'$, $L_3'$, $L_4'$, $p_1'$ and $n_1'$ have the same meanings as $Z_1$, $R_1$, $R_2$, $L_1$, $L_2$, $L_3$, $L_4$, $p_1$ and $n_1$, respectively;

(IV)

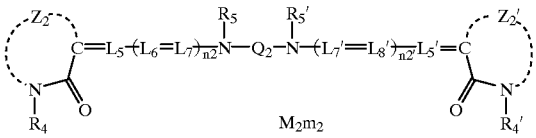

wherein $Z_2$ represents atomic groups required for completing an acidic nucleus, $R_4$ and $R_5$ each represents an alkyl group, an aryl group or a heterocyclic group, $L_5$, $L_6$ and $L_7$ each represents a methine group, $n_2$ represents 0, 1, 2, 3 or 4. $M_2$ represents a counter ion for adjusting the balance of charge, and $m_2$ represents the number of counter ions required for neutralizing the charges in a molecule, which is from 0 to 10, $Q_2$ represents a divalent linking group or a single bond, and $Z_2'$, $R_4'$, $R_5'$, $L_5'$, $L_6'$, $L_7'$ and $n_2'$ have the same meanings as $Z_2$, $R_4$, $R_5$, $L_5$, $L_6$, $L_7$ and $n_2$, respectively.

7. The silver halide photographic material as claimed in claim 6, wherein the aspect ratio of said silver halide grains is from 3 to 50.

8. The silver halide photographic material as claimed in claim 6, wherein the aspect ratio of said silver halide grains is from 5 to 50.

* * * * *